US009852570B2

(12) United States Patent
Ono

(10) Patent No.: US 9,852,570 B2
(45) Date of Patent: Dec. 26, 2017

(54) CASH PROCESSING DEVICE AND CASH PROCESSING METHOD

(71) Applicant: Oki Electric Industry Co., Ltd., Tokyo (JP)

(72) Inventor: Kaoru Ono, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/112,704

(22) PCT Filed: Oct. 3, 2014

(86) PCT No.: PCT/JP2014/076588

§ 371 (c)(1),
(2) Date: Jul. 20, 2016

(87) PCT Pub. No.: WO2015/136754

PCT Pub. Date: Sep. 17, 2015

(65) Prior Publication Data

US 2017/0169647 A1 Jun. 15, 2017

(30) Foreign Application Priority Data

Mar. 14, 2014 (JP) ..... 2014-051669

(51) Int. Cl.
*G07F 9/02* (2006.01)
*G07D 11/00* (2006.01)
*G07F 19/00* (2006.01)

(52) U.S. Cl.
CPC ..... *G07D 11/0018* (2013.01); *G07D 11/0039* (2013.01); *G07D 11/0051* (2013.01); *G07F 19/202* (2013.01)

(58) Field of Classification Search
CPC ..... G07D 11/0018; G07D 11/0021; G07D 11/0039; G07D 11/006; G07D 2211/00; G07F 7/04; G07F 19/00; G07F 19/202
See application file for complete search history.

(56) References Cited

U.S. PATENT DOCUMENTS 5,167,571 A 12/1992 Waller
5,917,930 A 6/1999 Kayani et al.
(Continued)

FOREIGN PATENT DOCUMENTS

JP 2003-281597 A 10/2003
JP 2010-282535 A 12/2010
(Continued)

*Primary Examiner* — Mark Beauchaine
(74) *Attorney, Agent, or Firm* — Rabin & Berdo, P.C.

(57) ABSTRACT

A cash processing device includes a cash inlet, a temporary reserving unit, storage units, a transport unit, and a control unit that controls a display of a deposit information screen, including a counting result obtained by the recognition unit, after the transport of the cash input to the cash inlet to the temporary reserving unit ends, and further configured to not instruct to open the opening and closing member when the first deposit method is selected and to instruct to open the opening and closing member when the second deposit method is selected, after receipt by the device of a confirmation that the counting result is correct, and before transport of the cash stored in the temporary reserving unit to the storage units ends.

14 Claims, 16 Drawing Sheets

(56) References Cited

U.S. PATENT DOCUMENTS

| | | | | |
|---|---|---|---|---|
| 2006/0108732 | A1 | 5/2006 | Kanno et al. | |
| 2008/0142583 | A1* | 6/2008 | Yokoi ..... | G07D 11/0018 235/379 |
| 2014/0291110 | A1 | 10/2014 | Adachi et al. | |

FOREIGN PATENT DOCUMENTS

| | | | |
|---|---|---|---|
| JP | 2012-150739 | A | 8/2012 |
| JP | 2013-117899 | A | 6/2013 |
| RU | 2163396 | C2 | 2/2001 |
| RU | 2285295 | C2 | 10/2006 |

* cited by examiner

CASH PROCESSING DEVICE AND CASH PROCESSING METHOD

TECHNICAL FIELD

The present invention relates to a cash processing device and a cash processing method.

BACKGROUND ART

Cash processing devices typified by cash processing devices for counter are installed in counters of branches of financial institutions and the like. Such cash processing devices are used in deposit processes, withdrawal processes of bills and coins, and the like. A bank teller performs manipulations of a cash processing device from, for example, a manipulation unit thereof, or from a reception terminal connected to the cash processing device, and thus can perform a deposit process by inputting bills into a cash inlet of the cash processing device. Patent Literature 1, for example, discloses such a cash processing device.

CITATION LIST

Patent Literature

Patent Literature 1: JP 2013-117899A

SUMMARY OF INVENTION

Technical Problem

There is a limit on the number of bills that can be input into a cash inlet at one time in the cash processing device. In addition, the cash inlet is generally closed until bills input into the cash inlet are transported to a bill storage unit in the inside of the device. For this reason, in order to deposit a number of bills exceeding the number of bills that can be input into the cash inlet one time, it is considered that an additional inputs of bills into the cash inlet are repeated at timings at which the cash inlet is opened according to the end of the transport of the bills to the bill storage unit. In the method of the additional input, however, there is a concern that the time taken to perform a deposit process on cash such as bills is lengthened.

Therefore, the present invention takes the above-described problem into account, and an object of the present invention is to provide a novel and improved cash processing device and cash processing method capable of carrying out a deposit process of cash more efficiently.

Solution to Problem

To solve the above described problem, according to an aspect of the present invention, there is provided a cash processing device including: a cash inlet having an opening and closing member; a temporary reserving unit configured to temporarily store cash; a storage unit configured to store cash; a transport unit configured to, in a deposit process, transport cash input into the cash inlet to the temporary reserving unit in a state in which the opening and closing member is closed, and transport cash stored in the temporary reserving unit to the storage unit; and a control unit configured to control a display of a selection screen for selecting a first deposit method of performing an input of cash at one time in one transaction or a second deposit method of performing inputs of cash over a plurality of times in one transaction, and to not instruct to open the opening and closing member when the first deposit method is selected and to instruct to open the opening and closing member when the second deposit method is selected, after transport of cash input into the cash inlet to the temporary reserving unit ends and before transport of the cash stored in the temporary reserving unit to the storage unit ends.

The control unit may control a display of the selection screen before a first input of cash into the cash inlet in one transaction.

The control unit may control a display of the selection screen after cash input into the cash inlet first in one transaction is transported to the temporary reserving unit.

In the second deposit method, the control unit may instruct to open the opening and closing member before an instruction to transport cash stored in the temporary reserving unit to the storage unit is issued.

In the second deposit method, the control unit may instruct to close the opening and closing member after transport of cash stored in the temporary reserving unit to the storage unit ends.

In second and succeeding inputs of cash in the second deposit method, when an input of cash into the cash inlet is sensed after an instruction to open the opening and closing member is issued, the control unit may instruct to close the opening and closing member based on the sensing.

The cash processing device may further include a cash outlet through which a client receives cash. In a withdrawal process, the transport unit may transport cash to the cash outlet from the storage unit and update balance-in-hand of the storage unit at a timing at which the cash is ejected from the storage unit.

When a jam occurs in the withdrawal process, the control unit may control a display of a screen indicating cash that has been transported to the cash outlet and cash remaining in the transport unit.

The control unit may control a display of a screen for selecting a timing at which the balance-in-hand of the storage unit is updated from a plurality of timings including a timing at which cash is ejected from the storage unit.

When a jam occurs during transport of cash from the cash inlet to the temporary reserving unit in the deposit process and cash remains in the cash inlet, the control unit may instruct to open the opening and closing member.

When a jam occurs during transport of cash from the cash inlet to the temporary reserving unit in the deposit process, the control unit may control a display of a screen indicating cash remaining in the transport unit.

The screen indicating the cash remaining in the transport unit may further indicate whether or not cash remains in the cash inlet.

To solve the above described problem, according to another aspect of the present invention, there is provided a cash processing method executed by a cash processing device which has a cash inlet having an opening and closing member, a temporary reserving unit configured to temporarily store cash, a storage unit configured to store cash, and a transport unit configured to, in a deposit process, transport cash input into the cash inlet to the temporary reserving unit in a state in which the opening and closing member is closed and transport cash stored in the temporary reserving unit to the storage unit, the cash processing method including: controlling a display of a selection screen for selecting a first deposit method of performing an input of cash at one time in one transaction or a second deposit method of performing inputs of cash over a plurality of times in one transaction; and issuing no instruction to open the opening and closing member when the first deposit method is selected, and instructing to open the opening and closing member when the second deposit method is selected, after transport of cash input into the cash inlet to the temporary reserving unit ends and before transport of cash stored in the temporary reserving unit to the storage unit ends.

Advantageous Effects of Invention

According to the present invention described above, it is possible to efficiently perform a cash deposit process.

DESCRIPTION OF EMBODIMENTS

Figure 1:
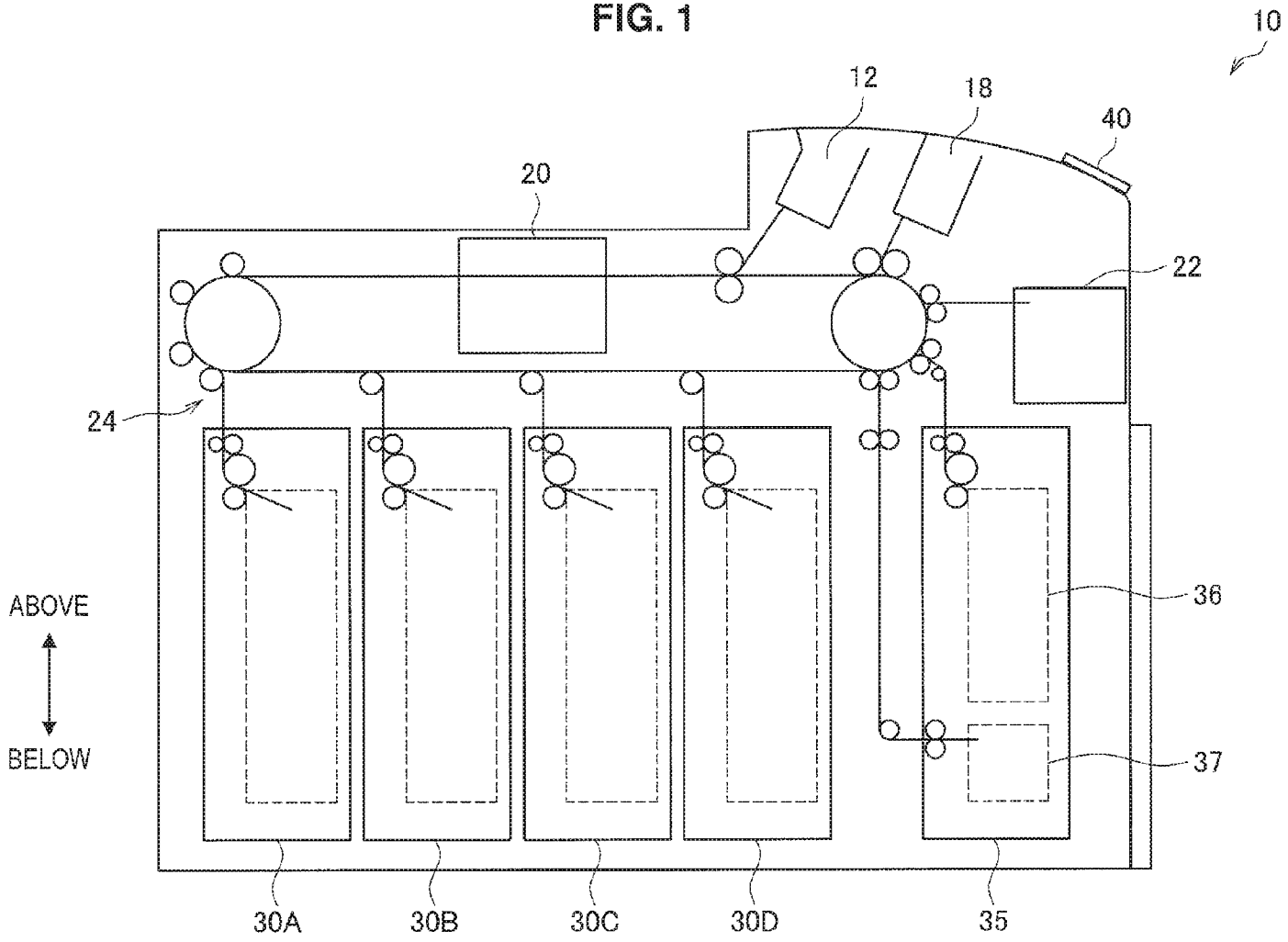
FIG. 1 is a diagram showing an internal configuration example of a bill processing device according to an embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

Note that, in this specification and the drawings, structural elements that have substantially the same function and structure are sometimes distinguished from each other using different alphabets after the same reference numeral. However, when there is no need in particular to distinguish structural elements that have substantially the same function and structure, the same reference numeral alone is attached.

<1. Overview of Bill Processing Device>

(1-1. Internal Configuration Example of Bill Processing Device)

First, an internal configuration example of a bill processing device 10 according to an embodiment of the present invention that is an example of a cash processing device will be described with reference to FIG. 1.

FIG. 1 is a diagram showing the internal configuration example of the bill processing device 10 according to the embodiment of the present invention. The bill processing device 10 is installed in a branch of a financial institution or the like. The bill processing device 10 is a staff-manipulation-type terminal for conducting transactions of bills based on manipulations performed by staff such as bank tellers of financial institutions who are manipulators of the device.

The bill processing device 10 has a cash inlet 12, a cash outlet 18, a bill recognition unit 20 that is an example of a bill discriminating unit, a temporary reserving unit 22 that is an example of a temporary accumulation unit, a transport unit 24, bill cassettes 30A to 30D that are examples of storage units, a bill cassette 35 with a reject storage, and a display unit 40 as shown in FIG. 1.

The cash inlet 12 is an input port of bills for a staff to input bills thereinto. In addition, the cash inlet 12 has a separation function of separating bills that are input in a bundle one by one and ejecting them. Note that the cash inlet 12 is provided with a cash inlet shutter 13 as an example of an opening and closing member to open and close an opening as shown in FIG. 2.

The cash outlet 18 is a dispensing port from which bills to be received by a staff are dispensed (withdrawn). The cash outlet 18 has an accumulation function of accumulating bills to be dispensed. The cash outlet 18 has a capacity at which 100 (the maximum accumulation number) bills can be accumulated as an example. Note that the cash outlet 18 is also provided with a cash outlet shutter 19 as an example of an opening and closing member to open and close an opening as shown in FIG. 2.

Figure 2A:
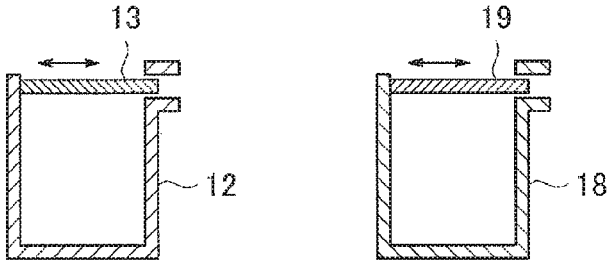
FIG. 2A is a schematic diagram showing configuration examples of a cash inlet shutter and a cash outlet shutter.
Figure 2B:
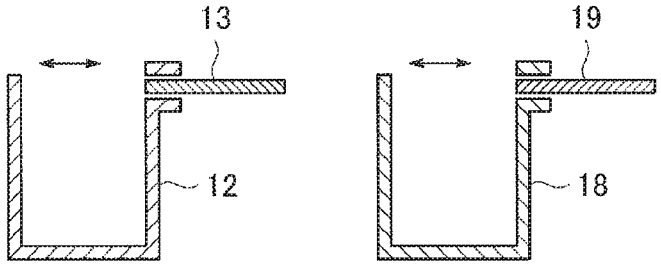
FIG. 2B is a schematic diagram showing configuration examples of a cash inlet shutter and a cash outlet shutter.

FIG. 2 shows schematic diagrams showing configuration examples of the cash inlet shutter 13 and the cash outlet shutter 19. In FIG. 2A, states in which the cash inlet shutter 13 and the cash outlet shutter 19 are closed are shown, and in FIG. 2B, states in which the cash inlet shutter 13 and the cash outlet shutter 19 are opened are shown. The cash inlet shutter 13 and the cash outlet shutter 19 move to close the cash inlet 12 and the cash outlet 18. Note that, when bills are to be transported from the cash inlet 12, the cash inlet shutter 13 is closed, and when bills are to be transported to the cash outlet 18, the cash outlet shutter 19 is closed. Note that, although, as an example, planar shutters are shown as the cash inlet shutter 13 and the cash outlet shutter 19 in FIG. 2, the cash inlet shutter 13 and the cash outlet shutter 19 may be curved shutters.

The bill recognition unit 20 discriminates bills passed therethrough one by one. Bills bi-directionally advance, and thus the bill recognition unit 20 can discriminate bills transported from the direction of the cash inlet 12 side and bills transported from an opposite direction thereto. Specifically, the bill recognition unit 20 discriminates denominations, genuineness (a genuine bill or a counterfeit bill), normality or defectiveness (a normal bill or a defective bill), feeding states (a normal state or an abnormal state), and the like of the bills transported through the transport unit 24, and makes a determination of normality or a determination of rejection on passed bills.

Here, in the present specification, the genuine bill refers to one discriminated as a bill, and the counterfeit bill refers to one that is not discriminated as a bill. In addition, the normal bill refers to one discriminated as being proper for deposit and withdrawal among bills discriminated as genuine bills, and the defective bill refers to a one discriminated as not being proper for deposit and withdrawal among the bills discriminated as the genuine bills. In addition, the determination of rejection is made based on factors such as the counterfeit bill, the defective bill (stained, damaged, having an abnormal outer shape, etc.), the abnormal feeding (a skewed bill, double feeding, etc.), or the like. In addition, rejected bills may include bills that are not treated as bills to be withdrawn (for example, a two-thousand-yen bill or a five-thousand-yen bill), or foreign bills.

The temporary reserving unit 22 has both functions of separation and accumulation of bills. For example, the temporary reserving unit 22 temporarily accumulates (stores) bills that are separated from the cash inlet 12 during a deposit process and discriminated as being normal by the bill recognition unit 20. Bills that are accumulated in the temporary reserving unit 22 are ejected when transactions are concluded, such as when calculation of the deposited bills with respect to accounts or the like is confirmed, pass through the bill recognition unit 20, and then are transported to the bill cassettes 30A to 30D, and the like. Note that the temporary reserving unit 22 may adopt an accumulation type in which bills are sequentially piled up and accumulated, or a drum type in which bills are sequentially rolled up and stored.

The transport unit 24 includes a transport path, a transport roller that transports bills, and a driving mechanism that drives the transport roller to transport bills one by one. The driving mechanism drives the transport roller as, for example, a DC servo motor, a pulse motor, or the like rotates. The transport unit 24 is controlled by a control unit to be described below, and transports bills to a target transport destination.

The bill cassettes 30A to 30D are bill storage units in which bills can be stored according to denominations, the bill cassettes 30A to 30D having both functions of accumulation and separation of bills. In addition, the bill cassettes 30A to 30D may include a plurality of bill cassettes for the same denomination. For example, the bill cassettes 30A and 30C may be bill cassettes for ten-thousand-yen bills, and the bill cassettes 30B and 30D may be bill cassettes for one-thousand-yen bills. In addition, the bill cassettes 30A to 30D are configured to be attachable to and detachable from the bill processing device 10, and by unfixing an installed bill cassette 30 from the bill processing device 10 and installing a bill cassette 30 in which a sufficient amount of bills are stored in the bill processing device 10, the bill processing device 10 can be loaded with the bills.

The bill cassette 35 with the reject storage (hereinafter referred to also as a bill cassette 35) is configured to be attachable to and detachable from the bill processing device 10, and collection and replenishment of bills are possible by replacing an installed bill cassette 35 with another bill cassette 35. In addition, the bill cassette 35 is provided with a bill storage 36 on its upper side and a reject storage 37 on its lower side (the bottom).

The bill storage 36 has an accumulation function of accumulating bills and a separation function of ejecting bills one by one. In addition, the bill storage 36 can accumulate bills separated from each of the bill cassettes 30A to 30D and can collect bills at the time of a cassette counting-type collection. In addition, the bill storage 36 can eject bills accumulated in the bill storage 36 and replenish the bill cassettes 30A to 30D with the bills in a cassette counting-type replenishment.

The reject storage 37 has only an accumulation function of accumulating bills therein. The reject storage 37 is a bill storage unit for accumulating bills that are discriminated as being abnormal (rejected bills) by the bill recognition unit 20 (a determination of rejection).

The display unit 40 displays a menu screen or a processing result screen. The display unit 40 is realized by, for example, a cathode ray tube (CRT) display device, a liquid crystal display (LCD) device, or an organic light emitting diode (OLED) device.

In addition, the bill processing device 10 has a manipulation unit (not illustrated) that can be manipulated by a staff. The bill processing device 10 performs deposit processes, withdrawal processes, and the like that correspond to transactions of deposit and withdrawal as a staff manipulates the manipulation unit. Note that the bill processing device 10 may perform processes based on manipulations by a staff on a reception terminal connected to the bill processing device 10 instead of the manipulation unit.

(1-2. Basic Processes of Bill Processing Device)

The internal configuration example of the bill processing device 10 according to the embodiment of the present invention has been described above with reference to FIGS. 1 and 2. Next, a deposit process, a withdrawal process, a replenishment process, and a collection process executed as basic process by the bill processing device 10 will be described.

(Deposit Process)

A deposit process is a process of accumulating bills input into the cash inlet 12 at the inside of the bill processing device 10, and is broadly divided into a counting process and a storing process. In the counting process, first, bills input into the cash inlet 12 are separated and ejected one by one, and the ejected bills are transported to the bill recognition unit 20 by the transport unit 24. Next, the bill recognition unit 20 discriminates the bills, and bills that are discriminated as being normal as a result of the discrimination are counted, transported to the temporary reserving unit 22, and accumulated therein. Thereafter, if the amount of the deposit is confirmed, the process proceeds to the storing process.

On the other hand, bills that are discriminated as being abnormal (rejected bills) as a result of the discrimination by the bill recognition unit 20 are accumulated in the cash outlet 18. The bills accumulated in the cash outlet 18 can undergo re-discrimination by the bill recognition unit 20 when a staff inputs the bills into the cash inlet 12 again.

In the storing process, first, bills are separated one by one from the temporary reserving unit 22, and the separated bills are transported to the bill recognition unit 20. Next, bills that are discriminated as being normal as a result of the discrimination by the bill recognition unit 20 are accumulated in the bill cassettes 30A to 30D that correspond to their denominations. On the other hand, bills that are discriminated as being abnormal as a result of the discrimination by the bill recognition unit 20 like bills that cause feeding abnormality such as a stained bill, a folded bill, or a skewed bill, are accumulated in the reject storage 37 of the bill cassette 35.

On the other hand, when an instruction to return (cancel a deposited bill is issued before confirmation of a deposit amount, the process transitions to a return process. In the return process, first, bills are separated one by one from the temporary reserving unit 22, and the separated bills are transported to the bill recognition unit 20. Then, all the bills are accumulated in the cash outlet 18 regardless of whether the result of the discrimination by the bill recognition unit 20 is normal or abnormal.

(Withdrawal Process)

A withdrawal process is a process of accumulating bills of the bill cassettes 30A to 30D in the cash outlet 18. In the withdrawal process, first, bills are separated one by one and ejected from the bill cassettes 30A to 30D according to a designated amount, and the ejected bills are transported to the bill recognition unit 20 by the transport unit 24. Next, the bill recognition unit 20 discriminates the bills, and bills that are discriminated as being normal as a result of the discrimination are accumulated in the cash outlet 18. Specifically, bills are accumulated (collected) in the cash outlet 18 according to, for example, the denominations or the numbers of normal bills to be withdrawn. On the other hand, bills that are discriminated as being abnormal as a result of the discrimination, i.e., bills that are not suitable for being provided to clients, are accumulated in the reject storage 37 of the bill cassette 35.

(Replenishment Process)

A replenishment process is a process of replenishing the bill processing device 10 with bills. As specific replenishing methods, a cash-inlet replenishment, a cassette replacement-type replenishment, and a cassette counting-type replenishment are possible in the bill processing device 10. The respective replenishing methods will be described below.

The cash-inlet replenishment is similar to the operation of the deposit process described above. For example, bills that are ejected from the cash inlet 12 and discriminated as being normal as a result of discrimination by the bill recognition unit 20 are drawn out to the temporary reserving unit 22 and then accumulated in the bill cassettes 30A to 30D according to their denominations. On the other hand, bills that are discriminated as being abnormal as a result of discrimination are accumulated in the cash outlet 18.

The cassette replacement-type replenishment uses the attachable and detachable bill cassettes 30A to 30D to replace any of the bill cassettes 30A to 30D that is installed in advance with a bill cassette that is loaded with bills in advance. Thereby, bills are replenished. Note that, in the cassette replacement-type replenishment, it is necessary for an operator to manually register the denominations and the number of replenished bills.

In the cassette counting-type replenishment, first, bills are loaded in the bill storage 36 of the bill cassette 35 in advance, and the bill cassette 35 is set in the bill processing device 10. Next, bills that are ejected from the bill storage 36 and discriminated as being normal as a result of discrimination by the bill recognition unit 20 are accumulated in the bill cassettes 30A to 30D that correspond to their denominations. On the other hand, bills that are discriminated as being abnormal as a result of the discrimination are accumulated in the reject storage 37. Note that, since a counting process is executed by the bill recognition unit 20 in the cassette counting-type replenishment, it is not necessary for an operator to manually register the denominations and the number of replenished bills.

(Collection Process)

The collection process is a process of collecting bills that are in the bill processing device 10. As specific collection methods, a cash-outlet collection, a cassette replacement-type collection, and a cassette counting-type collection are possible in the bill processing device 10. The respective collection methods will be described below.

The cash-outlet collection is similar to the operation of the withdrawal process described above. For example, bills that are ejected from the bill cassettes 30A to 30D that are collection objects and discriminated as being normal as a result of discrimination by the bill recognition unit 20 are accumulated in the cash outlet 18. On the other hand, bills that are discriminated as being abnormal as a result of the discrimination are accumulated in the reject storage 37. Then, performing discrimination with respect to all the bills accumulated in the bill cassettes 30A to 30D that are collection objects, a staff can collect the bills that have been determined to be normal from the cash outlet 18. In addition, the staff can collect the bills that have been determined to be abnormal from the reject storage 37.

In the cassette replacement-type collection, bills are collected by unfixing a predetermined bill cassette among the bill cassettes 30A to 30D from the bill processing device 10. Note that, in the cassette replacement-type collection, it is necessary for an operator to take out bills from the unfixed bill cassettes 30A to 30D and to manually count the denominations and the number of the collected bills.

In the cassette counting-type collection, bills that are ejected from a bill cassette that is a collection object among the bill cassettes 30A to 30D and discriminated as being normal as a result of discrimination by the bill recognition unit 20 are accumulated in the bill storage 36 of the bill cassette 35. On the other hand, bills that are discriminated as being abnormal as a result of the discrimination are accumulated in the reject storage 37. Thereafter, a staff can collect the bills determined to be normal and the bills determined to be abnormal by unfixing only the bill cassette 35 from the bill processing device 10. In addition, because a counting process is executed by the bill recognition unit 20 in the cassette counting-type collection, it is not necessary for an operator to manually count the denominations and the number of the collected bills.

(1-3. Background of Embodiment of Present Invention)

In a general bill processing device, it is not possible to additionally input bills into a cash inlet because a cash inlet shutter is closed during a deposit process. In addition, although rejected bills are accumulated in a cash outlet during a deposit process, it is not possible to take out the rejected bills during the deposit process. In other words, it is not possible to additionally input bills or to take out rejected bills until a counting process of a bill input into the cash inlet (included in the deposit process) is completed. For this reason, it takes a long period of time to deposit a large number of bills.

On the other hand, an additional input of bills into a cash inlet may be received during a storing process by opening the cash inlet shutter at all times after all bills deposited from the cash inlet are transported to the temporary reserving unit. According to this configuration, it is expected to shorten a time taken to deposit bills of which the number is equal to or greater than the number of bills that can be input into the cash inlet at one time.

However, in the method described above, since the cash inlet shutter is uniformly opened even when no additional input of a bill is performed, there is a concern that a foreign substance is introduced into the cash inlet due to unnecessary opening of the cash inlet shutter.

Therefore, the bill processing device 10 according to an embodiment of the present invention has been created focusing on the above circumstance. The bill processing device 10 according to the embodiment of the present invention can realize efficiency of bill deposit processes and improvement in the problem of foreign substances being introduced into the cash inlet. A configuration and an operation of the bill processing device 10 according to the embodiment of the present invention will be sequentially described in detail.

<2. Functional Configuration of Bill Processing Device>

Figure 3:
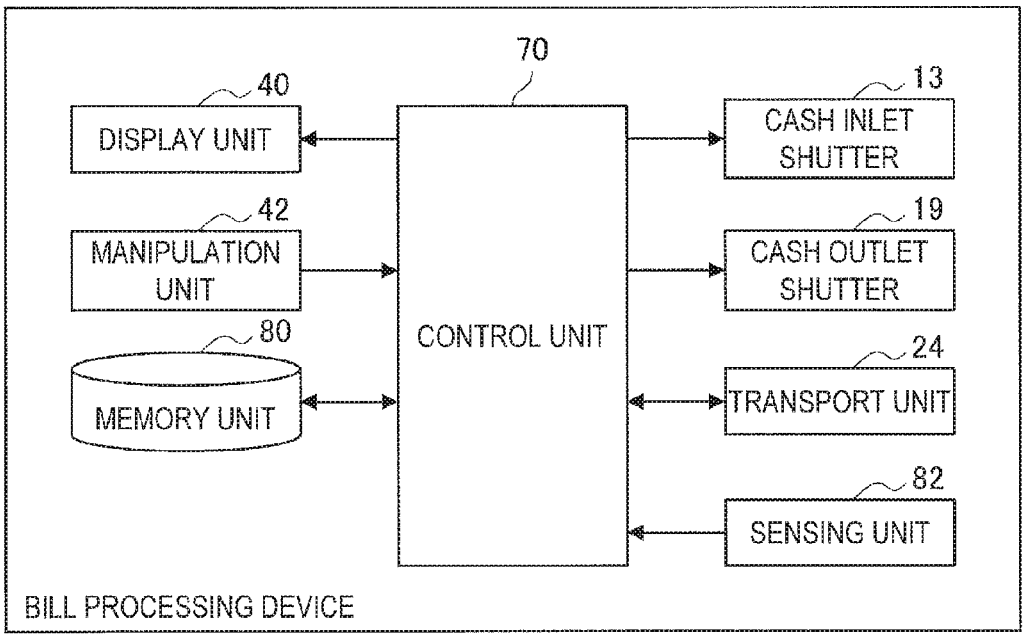
FIG. 3 is a functional block diagram showing a configuration of a bill processing device according to an embodiment of the present invention.

FIG. 3 is a functional block diagram showing a configuration of the bill processing device 10 according to the embodiment of the present invention. As shown in FIG. 3, the bill processing device 10 is provided with the cash inlet shutter 13, the cash outlet shutter 19, the transport unit 24, the display unit 40, a manipulation unit 42, a control unit 70, a memory unit 80, and a sensing unit 82. The cash inlet shutter 13, the cash outlet shutter 19, the transport unit 24, the display unit 40, and the manipulation unit 42 are as described with reference to FIGS. 1 and 2.

The control unit 70 controls overall operations of the bill processing device 10. For example, the control unit 70 controls the basic processes such as the deposit process, the withdrawal process, the replenishment process, and the collection process described above according to manipulations of a staff using the manipulation unit 42. Specifically, the control unit 70 controls the transport of bills by the transport unit 24 and the opening and closing operations of the cash inlet shutter 13 and the cash outlet shutter 19 for the execution of the basic processes. In addition, the control unit 70 controls a display of various screens to cause the various screens to be displayed on the display unit 40. For example, the control unit 70 controls display of selection screens (a deposit method setting screen and a deposit selection screen) for selecting a normal deposit in which an input of bills is performed once in one transaction (a first deposit method) or a mass deposit in which inputs of bills are performed over a plurality of times in one transaction (a second deposit method) (details of the methods will be described later). Then, the control unit 70 controls the deposit process according to a deposit method selected on the selection screen.

The memory unit 80 memorizes a program and the like by which the bill processing device 10 is operated. In addition, the memory unit 80 can memorize discrimination results of the bill recognition unit 20.

The sensing unit 82 has, for example, an optical sensor and the like to sense various states. For example, the sensing unit 82 detects accumulation states of bills of the cash inlet 12 and the cash outlet 18 (the number of accumulated bills and whether or not a bill has been taken out). In addition, the sensing unit 82 can sense transport states of bills, ejection of bills from the bill cassettes 30, and the like.

Note that the functions of the control unit 70 and the memory unit 80 described above may be realized as a hardware configuration constituted by a central processing unit (CPU), a read only memory (ROM), a random access memory (RAM), and the like. The CPU has an arithmetic operation function and a control function, and controls overall operations of the bill processing device 10 according to various programs. The ROM memorizes a program used by the CPU, arithmetic operation parameters, and the like. The RAM temporarily memorizes a program used in execution of the CPU, parameters that appropriately change in the execution, and the like.

The bill processing device 10 described above can perform a variety of operations based on the control of the control unit 70. A plurality of operations that can be executed by the bill processing device 10 will be sequentially described below in detail.

<3. First Operation>

In a first operation, the control unit 70 controls the display of the deposit method setting screen prior to a deposit process, and when a normal deposit is selected, the cash inlet shutter 13 is not opened after a deposited bill is transported to the temporary reserving unit 22, and when a mass deposit is selected, the cash inlet shutter 13 is opened after deposited bills are transported to the temporary reserving unit 22. According to this configuration, when the normal deposit is selected, i.e., when no additional input of bills is performed, the cash inlet shutter 13 is not opened, which can prevent a foreign substance from being introduced into the cash inlet 12. On the other hand, when the mass deposit is selected, additional input of bills into the cash inlet 12 can be performed in parallel with a storing process due to the opening of the cash inlet shutter 13, and therefore, efficiency in the deposit process can be attained. The first operation will be described below in more detail with reference to FIGS. 4 to 7.

(Normal Deposit)

Figure 4:
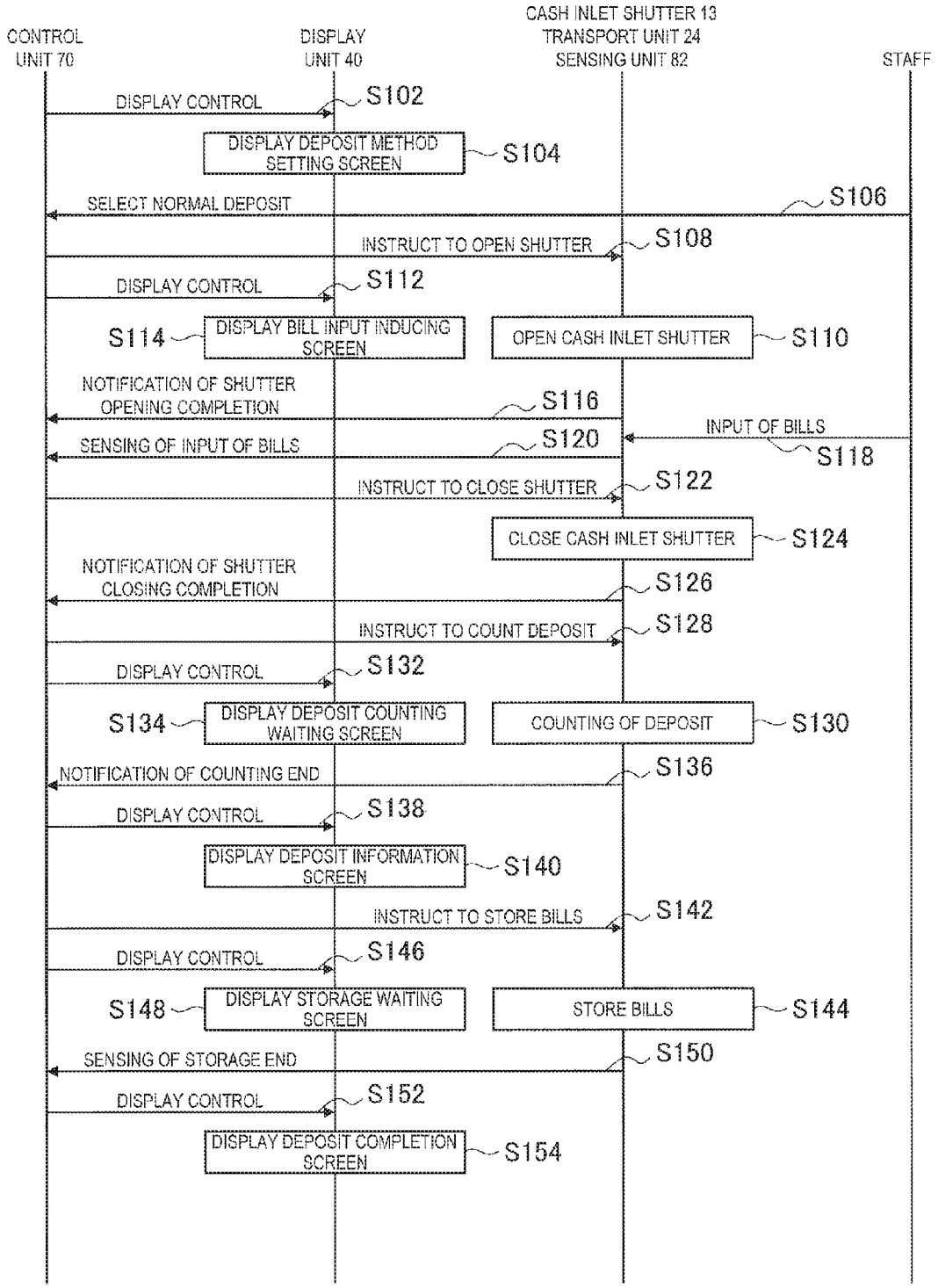
FIG. 4 is an illustrative diagram showing an operation example of a normal deposit.
Figure 5:
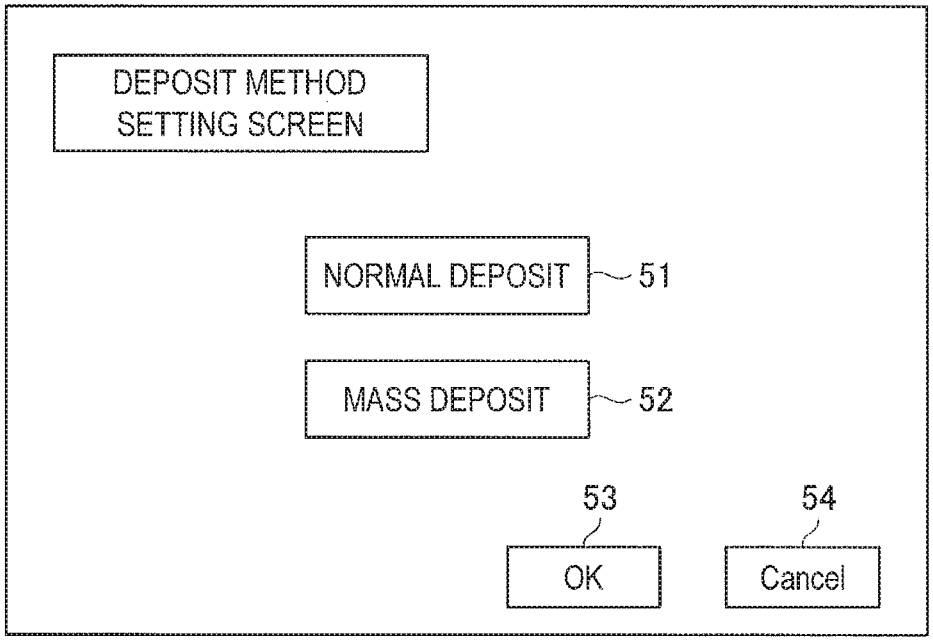
FIG. 5 is an illustrative diagram showing a specific example of a deposit method setting screen.

FIG. 4 is an illustrative diagram showing an operation example of a normal deposit. As shown in FIG. 4, first, the display unit 40 displays the deposit method setting screen based on the display control of the control unit 70 (S102 and S104). The deposit method setting screen includes, for example, a normal deposit selection button 51, a mass deposit selection button 52, an OK button 53, and a cancel button 54 as shown in FIG. 5. When the OK button 53 is selected in a state in which the normal deposit selection button 51 is selected, a deposit method is set to normal deposit, and when the OK button 53 is selected in a state in which the mass deposit selection button 52 is selected, the deposit method is set to mass deposit. When the cancel button 54 is selected, current settings are maintained. Here, description will be continued on the assumption that a staff selects the normal deposit selection button 51 (S106) as shown in FIG. 4 and thus the deposit method is set to normal deposit.

When a staff selects a deposit method, the control unit 70 instructs to open the cash inlet shutter 13 (S108), then the cash inlet shutter 13 is opened based on the instruction (S110), and a notification of a shutter opening completion is output to the control unit 70 (S116). In addition, the display unit 40 displays a bill input inducing screen to induce an input of bills by the staff based on the display control of the control unit 70 (S112 and S114).

Thereafter, when the staff inputs bills into the cash inlet 12 (S118), the sensing unit 82 notifies the control unit 70 of a sensing of the input of the bills (S120). The control unit 70 receives the notification and instructs to close the cash inlet shutter 13 (S122), then the cash inlet shutter 13 is closed based on the instruction (S124), and then a notification of a shutter closing completion is output to the control unit 70 (S126).

Next, the control unit 70 instructs the transport unit 24 to perform a counting process of the deposited bills (S128), and the transport unit 24 starts the counting process based on the instruction (S130). Through this counting process, the bills input into the cash inlet 12 are transported to the temporary reserving unit 22. In addition, the display unit 40 displays a deposit counting waiting screen indicating that the counting process of the deposited bills is being performed based on the display control of the control unit 70 (S132 and S134). Then, the transport unit 24 outputs a notification of a counting end to the control unit 70 when the counting process ends (S136).

Next, the display unit 40 displays a deposit information screen that includes the number of bills obtained in the counting process based on the display control of the control unit 70 (S138 and S140). Thereafter, the control unit 70 instructs the transport unit 24 to perform a storing process of bills (S142), and the transport unit 24 starts the storing process based on the instruction (S144). In addition, the display unit 40 displays a storage waiting screen indicating that the deposited bills are undergoing the storing process based on the display control of the control unit 70 (S146 and S148). Then, the transport unit 24 outputs a notification of a storage end to the control unit 70 when the storing process ends (S150). Thereafter, the display unit 40 displays a deposit completion screen indicating the completion of the deposit process based on the display control of the control unit 70 (S154), and thereby the normal deposit ends.

In the first operation, a staff can select a deposit method through the display of the deposit method setting screen as described above. In addition, in the normal deposit, the cash inlet shutter 13 is not opened and its closed state is maintained after the counting process ends. For this reason, when the number of bills to be deposited is equal to or fewer than the number of bills that can be input at one time, the staff selects the normal deposit on the deposit method setting screen to maintain the closing of the cash inlet shutter 13 after the counting process, which can prevent a foreign substance from being introduced into the cash inlet 12.

(Mass Deposit)

Figure 6:
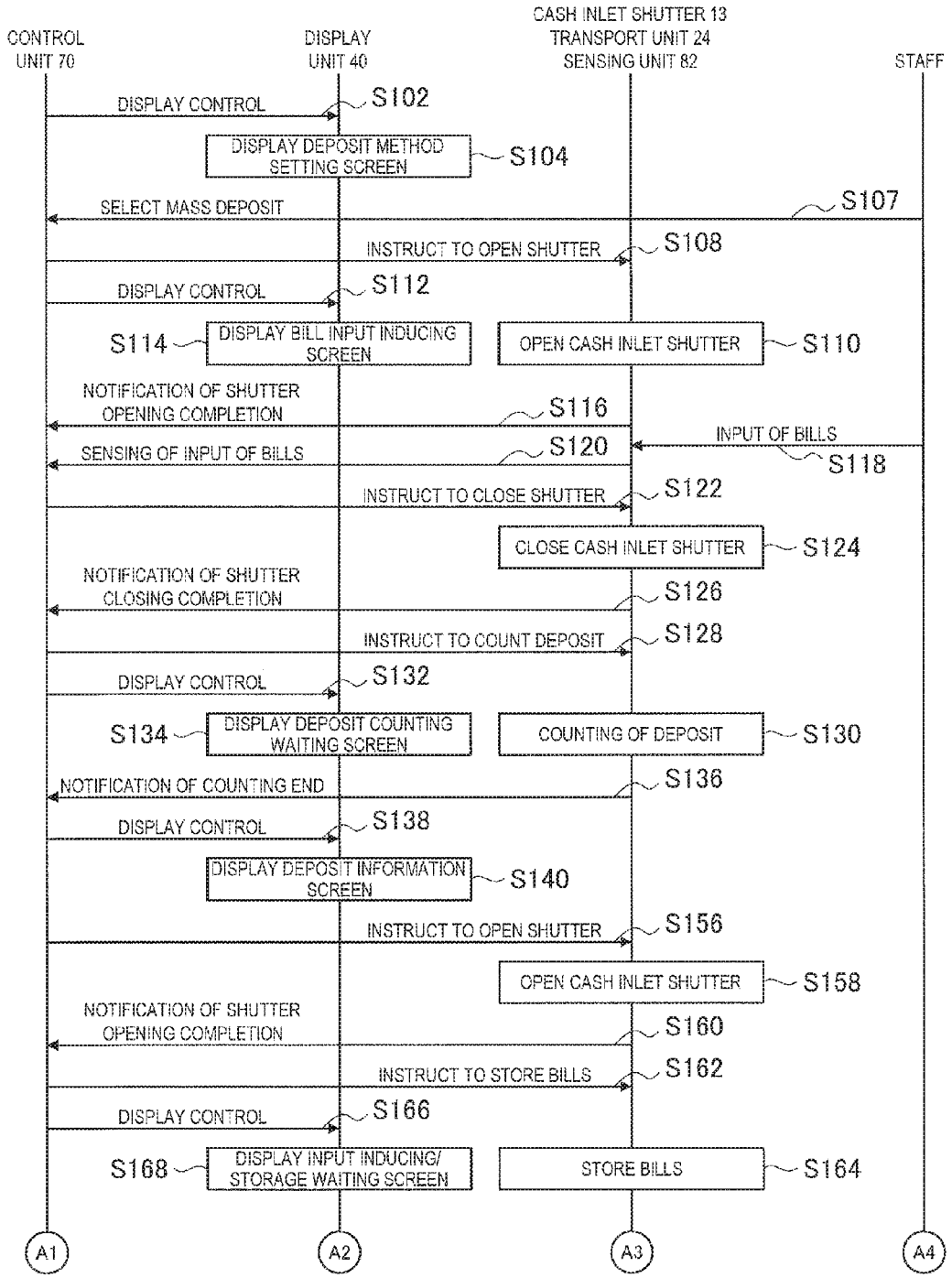
FIG. 6 is an illustrative diagram showing an operation example of a mass deposit.
Figure 7:
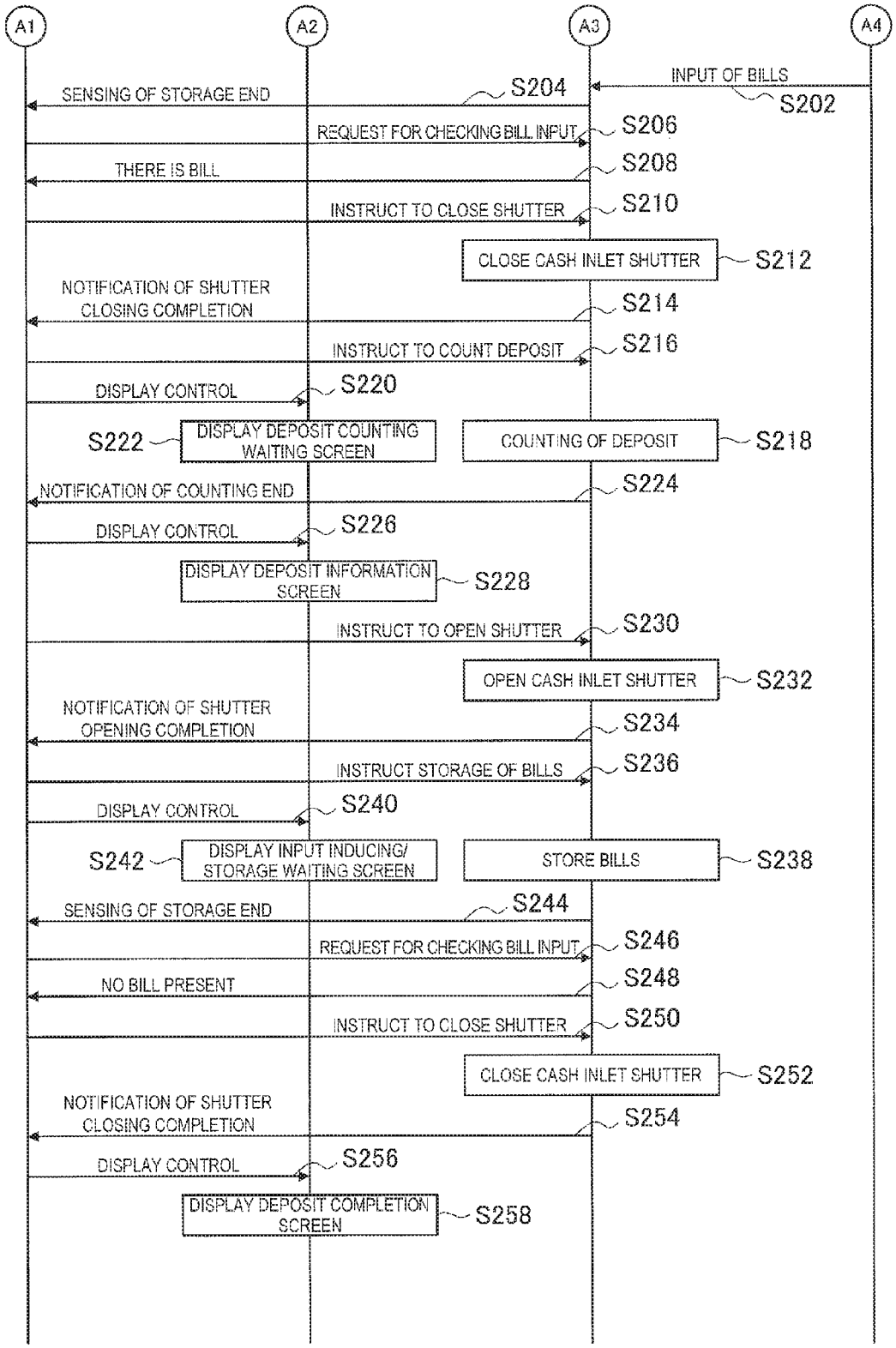
FIG. 7 is an illustrative diagram showing an operation example of a mass deposit.

FIGS. 6 and 7 are illustrative diagrams showing an operation example of a mass deposit. As shown in FIG. 6, first, the display unit 40 displays the deposit method setting screen based on the display control of the control unit 70 (S102 and S104). Here, description will be continued on the assumption that a staff selects the mass deposit selection button 52 on the deposit method setting screen (S107), and thereby the deposit method is set to mass deposit as shown in FIG. 6. Note that, since the processes of S108 to S140 of the mass deposit are the same as the processes of S108 to S140 of the normal deposit, detailed description will be omitted here.

After causing the display unit 40 to display the deposit information screen in S140, the control unit 70 instructs to open the cash inlet shutter 13 (S156), then the cash inlet shutter 13 is opened based on the instruction (S158), and a notification of a shutter opening completion is output to the control unit 70 (S160). Furthermore, the control unit 70 instructs the transport unit 24 to perform a storing process of bills (S162), and the transport unit 24 starts the storing process based on the instruction (S164). In addition, the display unit 40 displays an input inducing/storage waiting screen indicating that the deposited bills are undergoing the storing process and inducing the staff to input bills based on the display control of the control unit 70 (S166 and S168).

Thereafter, the staff additionally inputs bills into the cash inlet 12 (S202) as shown in FIG. 7. Then, the transport unit 24 outputs a notification of a storage end to the control unit 70 when the storing process ends (S204). Upon receiving the notification of storage end, the control unit 70 outputs a request for checking whether or not there is a remaining bill in the cash inlet 12 to the sensing unit 82 (S206), and the sensing unit 82 notifies the control unit 70 about the fact that there is a bill (S208).

Then, the control unit 70 instructs to close the cash inlet shutter 13 (S210), then the cash inlet shutter 13 is closed based on the instruction (S212), and a notification of a shutter closing completion is output to the control unit 70 (S214).

Next, the control unit 70 instructs the transport unit 24 to perform a counting process on the deposited bill (S216), and then the transport unit 24 starts the counting process based on the instruction (S218). Through this counting process, the bills input into the cash inlet 12 are transported to the temporary reserving unit 22. In addition, the display unit 40 displays the deposit counting waiting screen indicating that the deposited bills are undergoing the counting process based on the display control of the control unit 70 (S220 and S222). Then, the transport unit 24 outputs a notification of a counting completion to the control unit 70 when the counting process ends (S224).

Next, the display unit 40 displays the deposit information screen that includes the number of bills obtained in the counting process of S218 and the total number of bills obtained in the previous counting processes including S218 based on the display control of the control unit 70 (S226 and S228).

Next, the control unit 70 instructs to open the cash inlet shutter 13 upon receiving, for example, a confirmation manipulation from the staff on the input information screen (S230), then the cash inlet shutter 13 is opened based on the instruction (S232), and then a notification of a shutter opening completion is output the control unit 70 (S234). Furthermore, the control unit 70 instructs the transport unit 24 to perform a storing process of bills (S236), and then the transport unit 24 starts the storing process based on the instruction (S238). In addition, the display unit 40 displays an input inducing/storage waiting screen indicating that the deposited bills are undergoing the storing process and inducing the staff to input bills based on the display control of the control unit 70 (S240 and S242).

Thereafter, the transport unit 24 outputs a notification of a storage end to the control unit 70 when the storing process ends (S244). Upon receiving the notification of the storage end, the control unit 70 outputs a request for checking whether or not there is a remaining bill in the cash inlet 12 to the sensing unit 82 (S246), and the sensing unit 82 notifies the control unit 70 about the fact that there are no bills (S248).

Then, the control unit 70 instructs to close the cash inlet shutter 13 (S250), then the cash inlet shutter 13 is closed based on the instruction (S252), and then a notification of a shutter closing completion is output to the control unit 70 (S254). Thereafter, the display unit 40 displays a deposit completion screen indicating the completion of the deposit process based on the display control of the control unit 70 (S256 and S258), and thereby the mass deposit ends.

As described above, in the first operation, a staff can select a deposit method through the display of the deposit method setting screen. In addition, in the mass deposit, since the cash inlet shutter 13 is opened after a counting process ends, an additional input of bills into the cash inlet 12 can be performed in parallel with a storing process. As a result, a time taken to perform a deposit process on bills of which the number is greater than the number of bills that can be input into the cash inlet 12 at one time can be shortened.

Note that, although the example in which the control unit 70 instructs to open the cash inlet shutter 13 prior to the instruction of the storing processes shown in S162 and S236 has been described in the above description, the instruction to open the cash inlet shutter 13 may be issued after an instruction of the storing process. According to this configuration, the timing of the notification of the storage end shown in S204 and S244 becomes earlier, and therefore, an overall time taken for the deposit process is expected to be further shorten.

In addition, although the example in which the control unit 70 ascertains the completion of a bill input based on the notification from the sensing unit 82 that there are no bills shown in S248 and the deposit process is thereafter completed without opening the cash inlet shutter 13 has been described above, the control unit 70 may ascertain the completion of a bill input based on an input completion manipulation by a staff and thereby complete the deposit process.

(Modified Example of Mass Deposit)

Next, a modified example of a mass deposit according to the first operation will be described. In the mass deposit described with reference to FIGS. 6 and 7, the cash inlet shutter 13 is closed after the storing process of bills ends as shown in S212 and S252. On the other hand, according to the modified example of the mass deposit, when an input of bills is sensed, the cash inlet shutter 13 is closed based on the sensing even before a storing process on the bills ends. According to this configuration, since the time during which the cash inlet shutter 13 is opened is reduced, it is possible to further suppress introduction of a foreign substance into the cash inlet 12. The modified example of the mass deposit according to the first operation will be described in detail with reference to FIG. 8.

Figure 8:
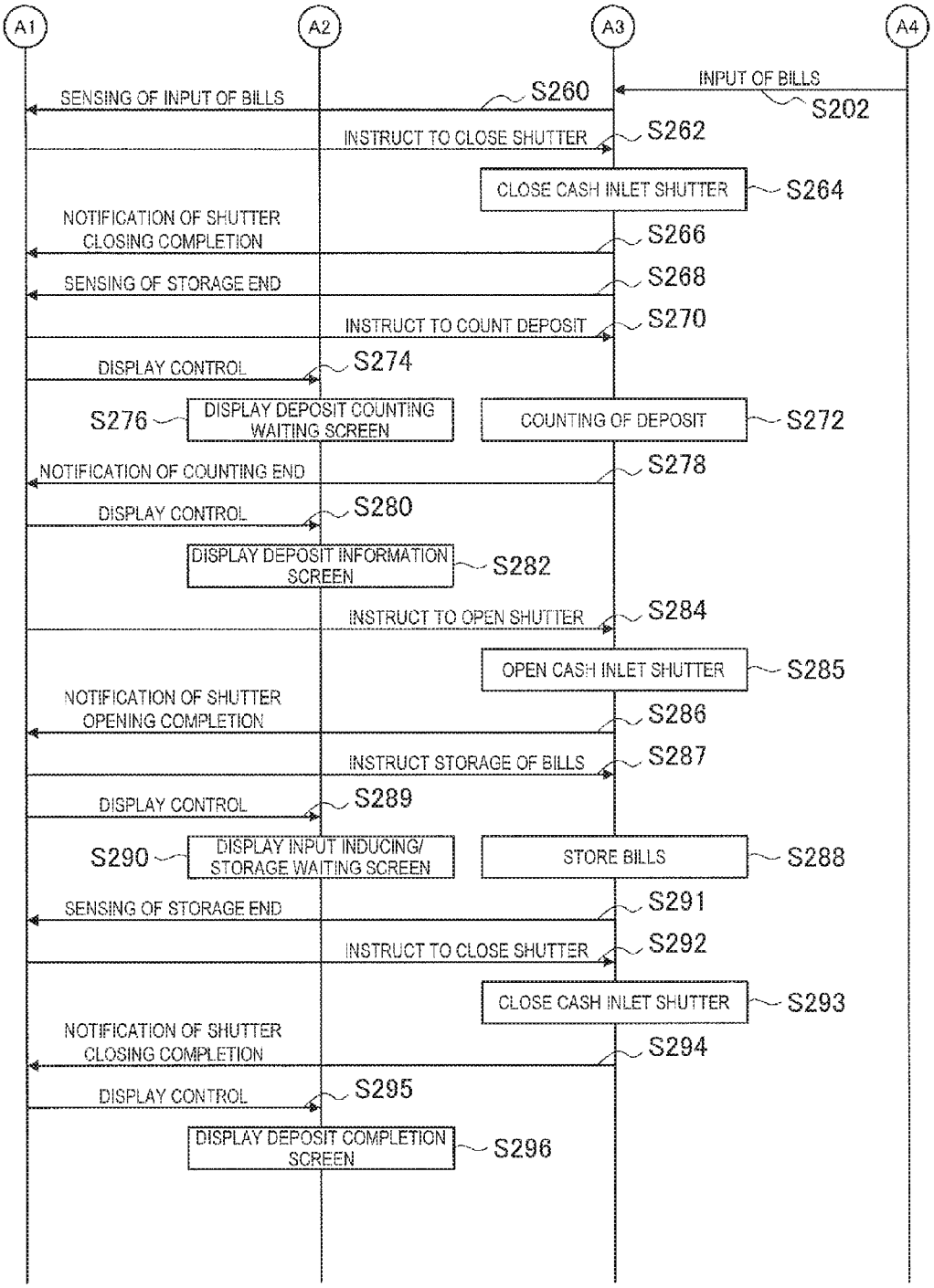
FIG. 8 is an illustrative diagram showing an operation example of a modified example of a mass deposit.

FIG. 8 is an illustrative diagram showing an operation example of the modified example of a mass deposit. Since processes up to the input of bills of S202 are the same as in the process of a mass deposit described with reference FIG. 6, detailed description will be omitted here.

In the modified example of the mass deposit, when a staff inputs bills into the cash inlet 12 (S202), the sensing unit 82 notifies the control unit 70 of sensing of the input of the bills (S260) as shown in FIG. 8. The control unit 70 receives the notification and instructs a closing of the cash inlet shutter 13 (S262), then the cash inlet shutter 13 is closed based on the instruction (S264), and then a notification of a shutter closing completion is output the control unit 70 (S266).

Thereafter, the transport unit 24 outputs a notification of a storage end to the control unit 70 when the storing process ends (S268). Upon receiving the notification of the storage end, the control unit 70 instructs the transport unit 24 to perform a counting process on the deposited bills (S270), and the transport unit 24 starts the counting process based on the instruction (S272). Through this counting process, the bills input into the cash inlet 12 are transported to the temporary reserving unit 22. In addition, the display unit 40 displays the deposit counting waiting screen indicating that the deposited bills are undergoing the counting process based on the display control of the control unit 70 (S274 and S276). Then, the transport unit 24 outputs a notification of a counting end to the control unit 70 when the counting process ends (S278).

Next, the display unit 40 displays the deposit information screen that includes the number of bills obtained in the counting process of S272 and the total number of bills obtained in the previous counting processes performed including S272 based on the display control of the control unit 70 (S280 and S282).

Next, the control unit 70 receives, for example, a confirmation manipulation by a staff on the deposit information screen, and instructs to open the cash inlet shutter 13 (S284), then the cash inlet shutter 13 is opened based on the instruction (S285), and then a notification of a shutter opening completion is output to the control unit 70 (S286). Further, the control unit 70 instructs the transport unit 24 to perform a storing process of the bills (S287), and the transport unit 24 starts the storing process based on the instruction (S288). In addition, the display unit 40 displays an input inducing/storage waiting screen indicating that the deposited bills are undergoing the storing process and inducing the staff to input bills based on the display control of the control unit 70 (S289 and S290).

Thereafter, the transport unit 24 outputs a notification of a storage end to the control unit 70 when the storing process ends (S291). Then, because the control unit 70 has not received a notification of a sensing of the input of bills up to this point of time, the control unit determines that there is no additional input of bills and instructs to close the cash inlet shutter 13 (S292). The cash inlet shutter 13 is closed based on the instruction (S293), and a notification of a shutter closing completion is output to the control unit 70 (S294). Thereafter, the display unit 40 displays the deposit completion screen indicating the completion of the deposit process based on the display control of the control unit 70 (S295 and S296), and thereby the mass deposit according to the modified example ends.

As described above, according to the modified example of the mass deposit, when the input of bills is sensed, the cash inlet shutter 13 is closed based on the sensing even before the storing process of bills ends, as shown in S260 and S262. According to this configuration, the time during which the cash inlet shutter 13 is opened is reduced, and thus it is possible to further suppress introduction of a foreign substance into the cash inlet 12.

Note that, although the example in which the control unit 70 determines that there is no additional input of bills based on the fact that the control unit has received no notification of an input of bills until S291 and the deposit process is completed without opening the cash inlet shutter 13 has been described above, the control unit 70 may ascertain the completion of an input of bills based on an input completion manipulation by a staff, and then the deposit process may be completed.

<4. Second Operation>

The first operation that can be performed by the bill processing device 10 has been described above. Next, a second operation that can be performed by the bill processing device 10 will be described. In the second operation, the control unit 70 controls a display of the deposit selection screen for selecting whether or not bills are to be additionally input each time a counting process ends, opens the cash inlet shutter 13 when an additional input is selected, and maintains the closed cash inlet shutter 13 when an end is selected. According to this configuration, the cash inlet shutter 13 is not opened after the final input of a bill, and thus it is possible to prevent a foreign substance from being introduced into the cash inlet 12. The second operation will be described below in detail with reference to FIGS. 9 to 11.

(Normal Deposit)

Figure 9:
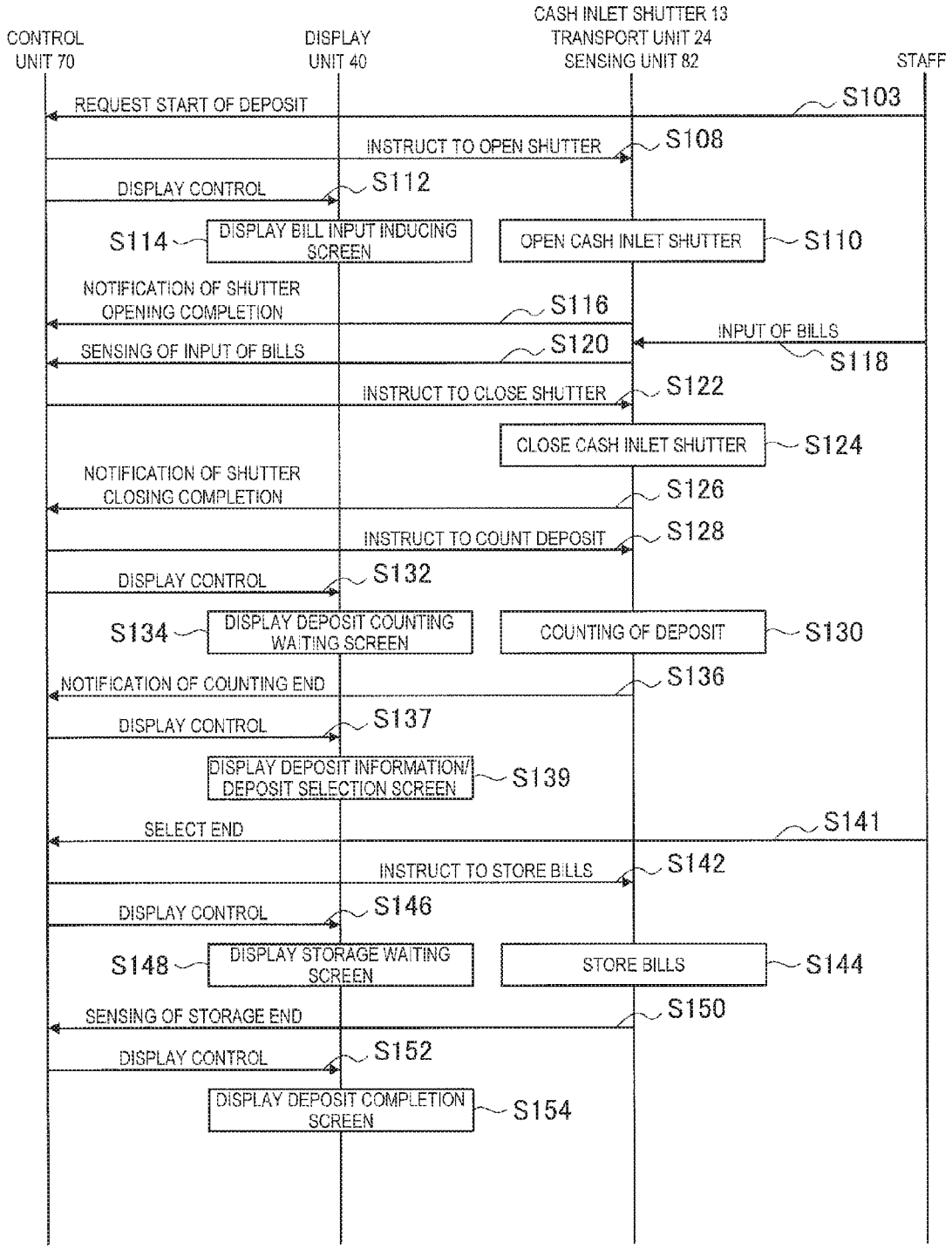
FIG. 9 is an illustrative diagram showing an operation example of a normal deposit.

FIG. 9 is an illustrative diagram showing an operation example of a normal deposit. As shown in FIG. 9, when a staff requests a start of a deposit from the bill processing device 10 (S103), the control unit 70 instructs to open the cash inlet shutter 13 (S108), and the cash inlet shutter 13 is opened based on the instruction (S110). Thereafter, the processes of S112 to S136 described with reference to FIG. 4 are performed.

Then, when counting of the deposited bills ends (S136), the display unit 40 displays a deposit information/deposit selection screen that includes the number of bills obtained in the counting process and a selection button for selecting whether or not an additional input is to be performed based on the display control of the control unit 70 (S137 and S139). Here, a specific example of the deposit information/deposit selection screen will be described with reference to FIG. 10.

Figure 10:
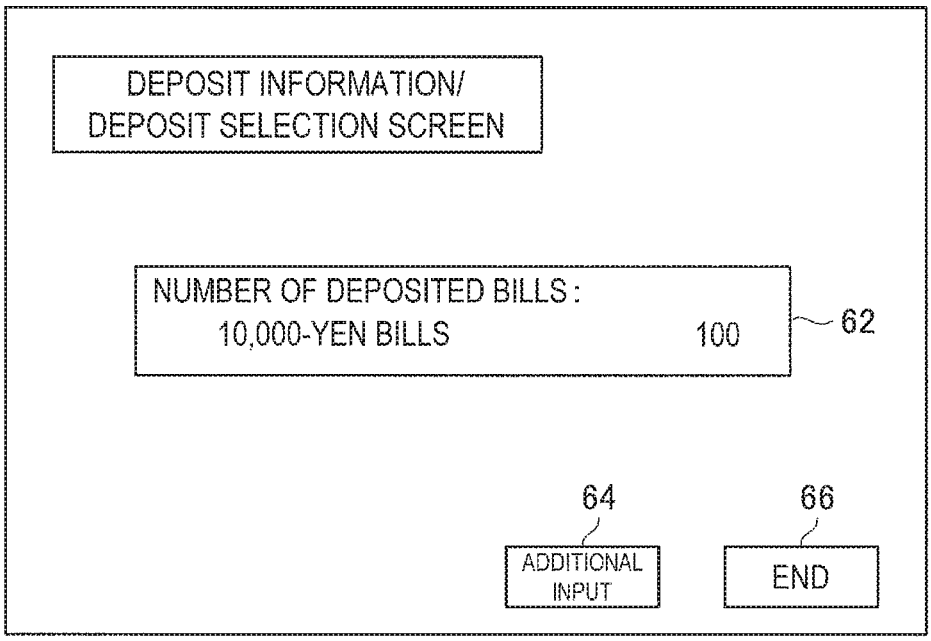
FIG. 10 is an illustrative diagram showing a specific example of a deposit information/deposit selection screen.

FIG. 10 is an illustrative diagram showing a specific example of the deposit information/deposit selection screen. As shown in FIG. 10, the deposit information/deposit selection screen includes a deposit information area 62 in which the number of deposited bills obtained through the counting process is indicated, an additional input selection button 64, and an end button 66. The additional input selection button 64 is selected when a staff desires an additional input of bills, and the end button 66 is selected when a staff desires an end of the deposit. Here, description will be continued on the assumption that a staff selects the end button 66 as shown in FIG. 9 (S141).

When the end button 66 is selected on the deposit information/deposit selection screen (S141), the control unit 70 instructs the transport unit 24 to perform a storing process of bills (S142), and the transport unit 24 starts the storing process based on the instruction (S144). In addition, the display unit 40 displays the storage waiting screen indicating that the deposited bills are undergoing the storing process based on the display control of the control unit 70 (S146 and S148). Then, the transport unit 24 outputs a notification of a storage end to the control unit 70 when the storing process ends (S150). Thereafter, the display unit 40 displays the deposit completion screen indicating the completion of the deposit process based on the display control of the control unit 70 (S152 and S154), and thereby the deposit process ends.

As described above, in the second operation, the deposit information/deposit selection screen for selecting whether or not bills are to be additionally input after the counting process ends is displayed. Then, when a staff selects the end button 66 on the deposit information/deposit selection screen displayed first, the deposit process ends with no additional input of bills. In other words, the selection of the end button 66 on the deposit information/deposit selection screen displayed first can also mean selection of a normal deposit. According to this second operation, the cash inlet shutter 13 is maintained to be closed after a counting process in the normal deposit as in the first operation, and therefore, it is possible to prevent a foreign substance from being introduced into the cash inlet 12.

(Mass Deposit)

Figure 11:
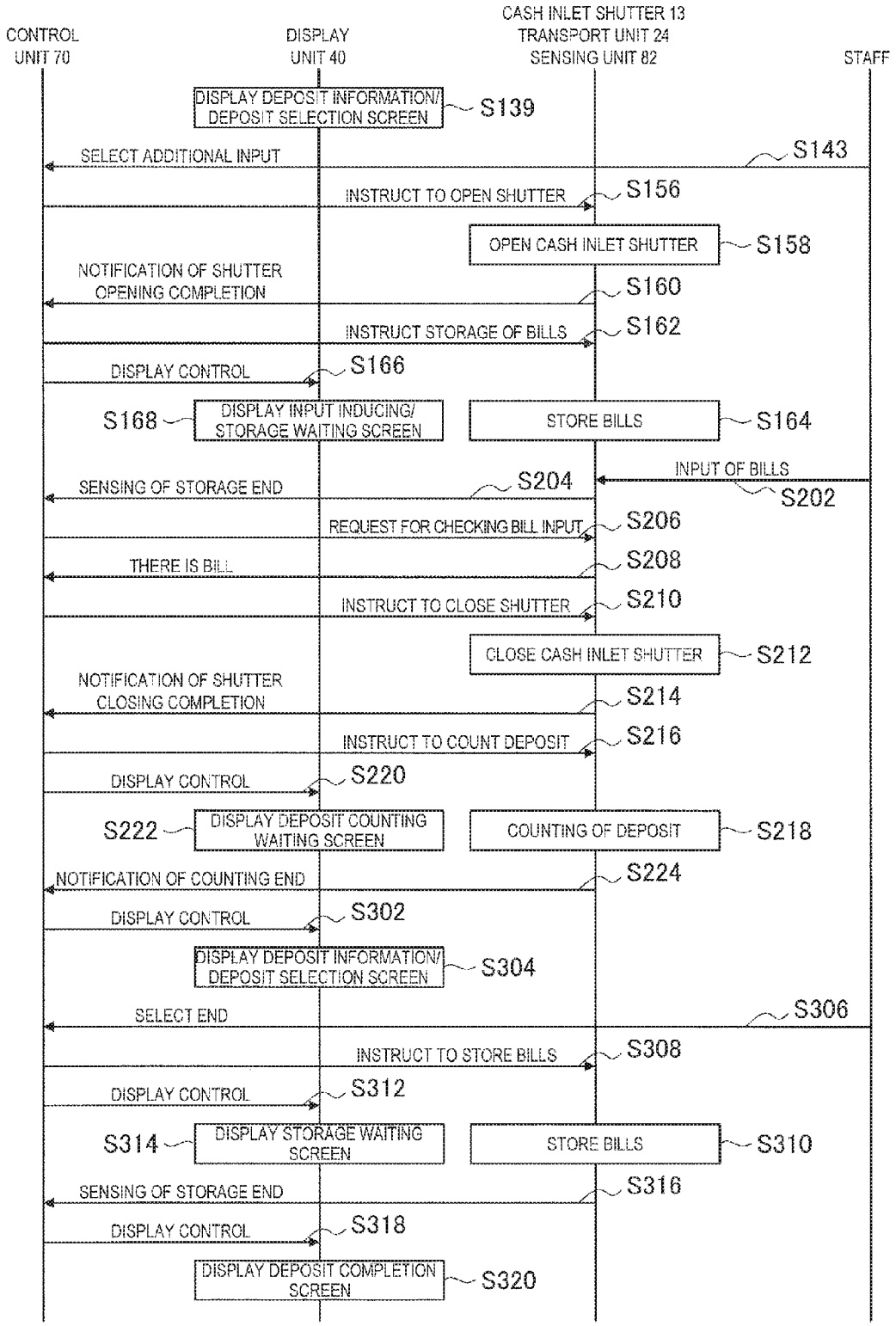
FIG. 11 is an illustrative diagram showing an operation example of a mass deposit.

FIG. 11 is an illustrative diagram showing an operation example of a mass deposit. Note that succeeding processes from S139 described in FIG. 9 as the process of the normal deposit are shown in FIG. 11, and preceding processes before S139 of a mass deposit are the same as those in the process of the normal deposit described in FIG. 9.

As shown in FIG. 11, when a staff selects the additional input selection button 64 on the deposit information/deposit selection screen (S143), the control unit 70 instructs to open the cash inlet shutter 13 (S156), and then the cash inlet shutter 13 is opened based on the instruction (S158). Thereafter, the processes from S160 to S224 described with reference to FIGS. 6 and 7 are performed.

Then, when the counting of deposited bills ends (S224), the display unit 40 displays the deposit information/deposit selection screen that includes deposit information and a selection button for selecting whether or not an additional input is to be performed based on the display control of the control unit 70 (S302 and S304). Note that the deposit information may include the number of bills obtained from the counting process of S218 and the total number of bills obtained from the previous counting processes including S218.

Thereafter, when the end button 66 is selected on the deposit information/deposit selection screen (S306), the control unit 70 instructs the transport unit 24 to perform a storing process on the bills (S308), and then the transport unit 24 starts the storing process based on the instruction (S310). In addition, the display unit 40 displays the storage waiting screen indicating that the deposited bills are undergoing the storing process based on the display control of the control unit 70 (S312 and S314). Then, the transport unit 24 outputs a notification of a storage end to the control unit 70 when the storing process ends (S316). Thereafter, the display unit 40 displays the deposit completion screen indicating the completion of the deposit process based on the display control of the control unit 70 (S318 and S320), and thereby the deposit process ends.

As described above, in the second operation, the deposit information/deposit selection screen for selecting whether or not an additional input of bills is to be performed is displayed each time a counting process ends. Then, when a staff selects the additional input selection button 64 on the deposit information/deposit selection screen, the cash inlet shutter 13 is opened, and thus an additional input of bills can be performed. In other words, the selection of the additional input selection button 64 on the deposit information/deposit selection screen can also mean selection of a mass deposit. According to this second operation, when the end button 66 is selected on the deposit information/deposit selection screen, the cash inlet shutter 13 is maintained to be closed after the final input of bills (S202) of the mass deposit, and thereby it is possible to prevent a foreign substance from being introduced into the cash inlet 12.

<5. Third Operation>

The second operation that can be performed by the bill processing device 10 has been described above. Next, a third operation that can be performed by the bill processing device 10 will be described. The third operation is an operation relating to a withdrawal process. In particular, the third operation relates to a setting of an update timing of balance-in-hand in the bill processing device 10 in a withdrawal process and a withdrawal process according to the setting. According to this third operation, a workload of a staff arising from the occurrence of a jam can be reduced as will be described below in detail. A withdrawal setting screen for setting a balance-in-hand update timing will be described, and then the flow of a process at each balance-in-hand update timing will be described below.

(Withdrawal Setting Screen)

Figure 12:
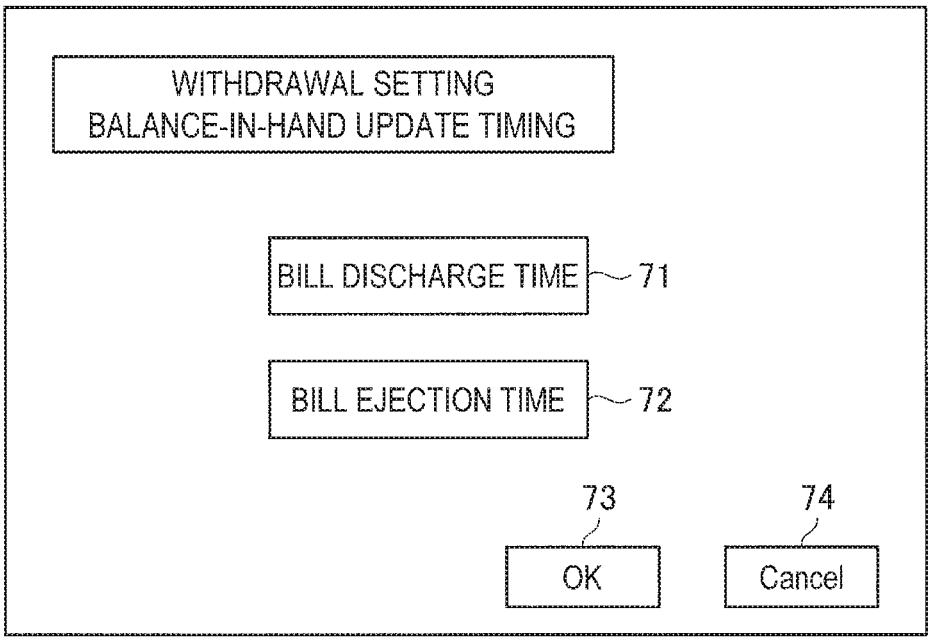
FIG. 12 is an illustrative diagram showing a specific example of a withdrawal setting screen.

FIG. 12 is an illustrative diagram showing a specific example of the withdrawal setting screen. As shown in FIG. 12, the withdrawal setting screen includes a bill discharge time selection button 71, a bill ejection time selection button 72, an OK button 73, and a cancel button 74.

The bill discharge time selection button 71 is a selection button for setting a balance-in-hand update timing to a bill discharge time in a withdrawal process. The bill discharge time may be a timing at which the cash outlet shutter 19 is opened. Although an example in which a timing at which the cash outlet shutter 19 is opened is a bill discharge time will be described below, a bill discharge time may be a timing at which bills have passed through the bill recognition unit 20 or a timing at which bills have been transported to the cash outlet 18. The bill ejection time selection button 72 is a selection button for setting a balance-in-hand update timing to a bill ejection time in a withdrawal process. The bill ejection time may be a timing at which bills are ejected from a bill cassette 30. The OK button 73 is a selection button for confirming a withdrawal setting, and the cancel button 74 is a selection button for maintaining a current withdrawal setting.

A staff can set a balance-in-hand update timing in a withdrawal process by manipulating the withdrawal setting screen described above.

(Balance-in-Hand Update Timing: Bill Discharge Time)

Next, a withdrawal process performed when a balance-in-hand update timing is set to a bill discharge time will be described with reference to FIG. 13.

Figure 13:
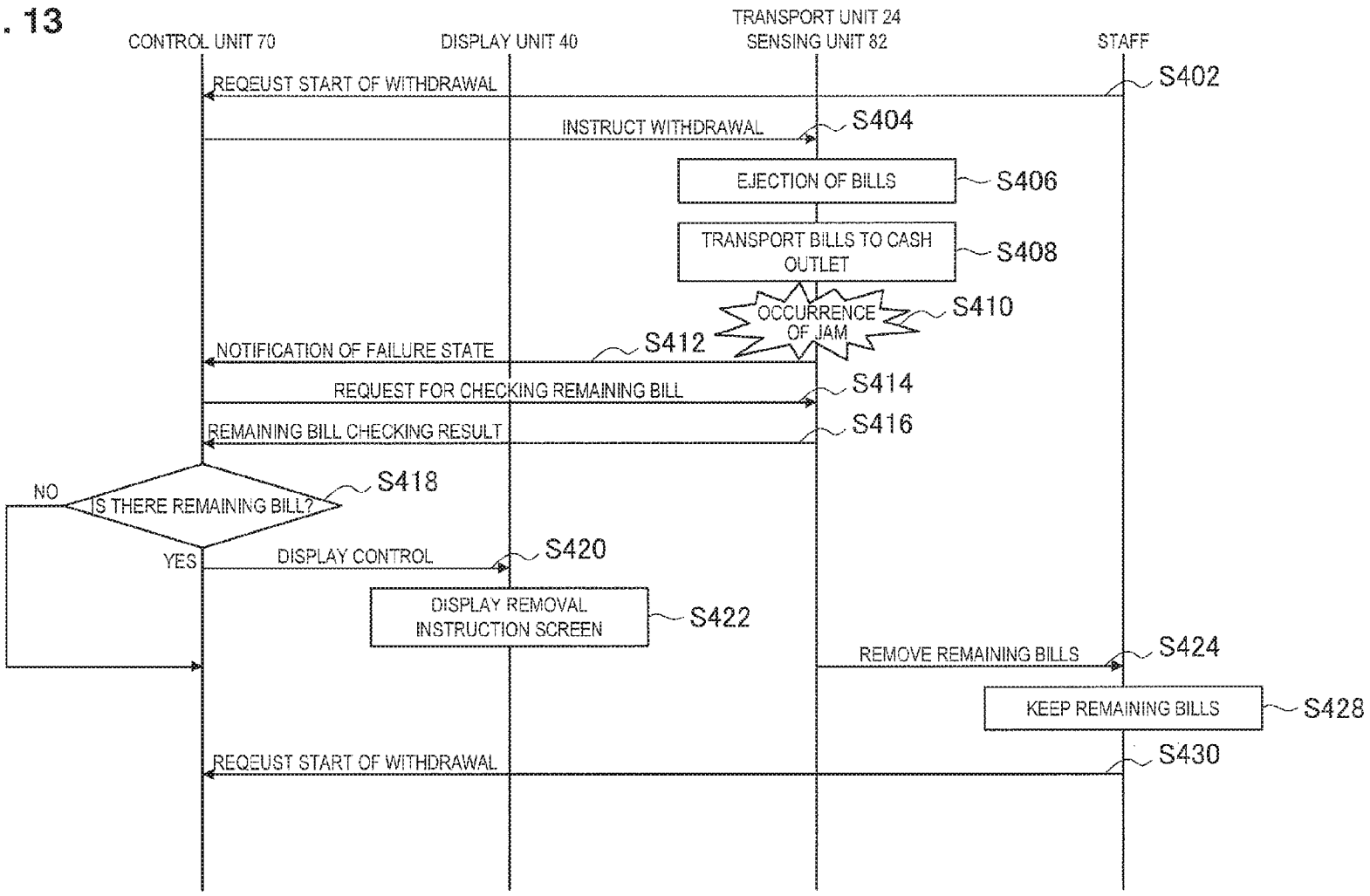
FIG. 13 is an illustrative diagram showing a withdrawal process when a balance-in-hand update timing is set to be a bill discharge time.

FIG. 13 is an illustrative diagram showing the withdrawal process performed when a balance-in-hand update timing is set to a bill discharge time. When a staff requests a start of a withdrawal from the bill processing device 10 (S402), the control unit 70 instructs the transport unit 24 to eject bills in a designated amount from the bill cassettes 30 (S404) as shown in FIG. 13. The transport unit 24 starts the ejection of bills from the bill cassettes 30 based on the instruction (S406), and transports the ejected bills to the cash outlet 18 (S408). Then, when a jam occurs before all the bills in the designated amount arrive at the cash outlet 18 (S410), a notification of a failure state is output to the control unit 70 in a state in which the bills remain in the transport unit 24 and the cash outlet 18 (S412).

Upon receiving the notification of the failure state, the control unit 70 requests checking of whether or not there is a remaining bill to be removed inside the bill processing device 10 from the sensing unit 82 (S414), and the sensing unit 82 responds with presence or absence and the position of the remaining bill to be removed inside the bill processing device 10 (S416). Note that the remaining bill to be removed inside the bill processing device 10 includes a bill remaining in the transport unit 24 and a bill that has been transported to the cash outlet 18.

Then, when there is a remaining bill (yes in S418), the display unit 40 displays a removal instruction screen instructing to remove the remaining bill based on the control of the control unit 70 (S420 and S422). Upon receiving the display of the removal instruction screen, the staff removes the bills remaining inside the bill processing device 10 (S424).

Here, in the present example in which a balance-in-hand update timing is a bill discharge time, since a balance-in-hand update process is not performed in the stage of S424 in which the staff removes the remaining bill, the remaining bills are bills that the bill processing device 10 recognizes as being present inside the device. However, manually returning the remaining bills into the inside of the bill processing device 10 is mechanically difficult, and if the remaining bills are returned to the inside of the bill processing device 10 using the transport function, the balance-in-hand managed in the device further increases, and thus the staff separately keeps the remaining bills removed in S424 in a different place from the bill cassettes 30 of the bill processing device 10 (S428). Thereafter, the staff requests a start of a withdrawal from the bill processing device 10 again (S430).

As described above, when a balance-in-hand update timing is a bill discharge time, a staff separately keeps remaining bills caused by the occurrence of a jam in a different place from the bill cassettes 30 of the bill processing device 10. Then, the separately kept remaining bills are used in a balancing process. The balancing process is a process of adding the actual number of bills inside the bill processing device 10 and the number of separately kept remaining bills together and checking whether or not the sum matches the balance-in-hand managed by the bill processing device 10.

However, since the remaining bills are separately kept in a different place from the bill cassettes 30 of the bill processing device 10, there is a concern that a mismatch occurs in the balancing process due to a loss of a remaining bill. Furthermore, it is necessary to count the remaining bills as different work from counting the bills inside the bill cassettes 30 of the bill processing device 10, a workload of a staff increases.

On the other hand, by setting a balance-in-hand update timing to a bill ejection time on the withdrawal setting screen, the above-described circumstance can improve. A withdrawal process when a balance-in-hand update timing is a bill ejection time will be described below.

(Balance-in-Hand Update Timing: Bill Ejection Time)

Figure 14:
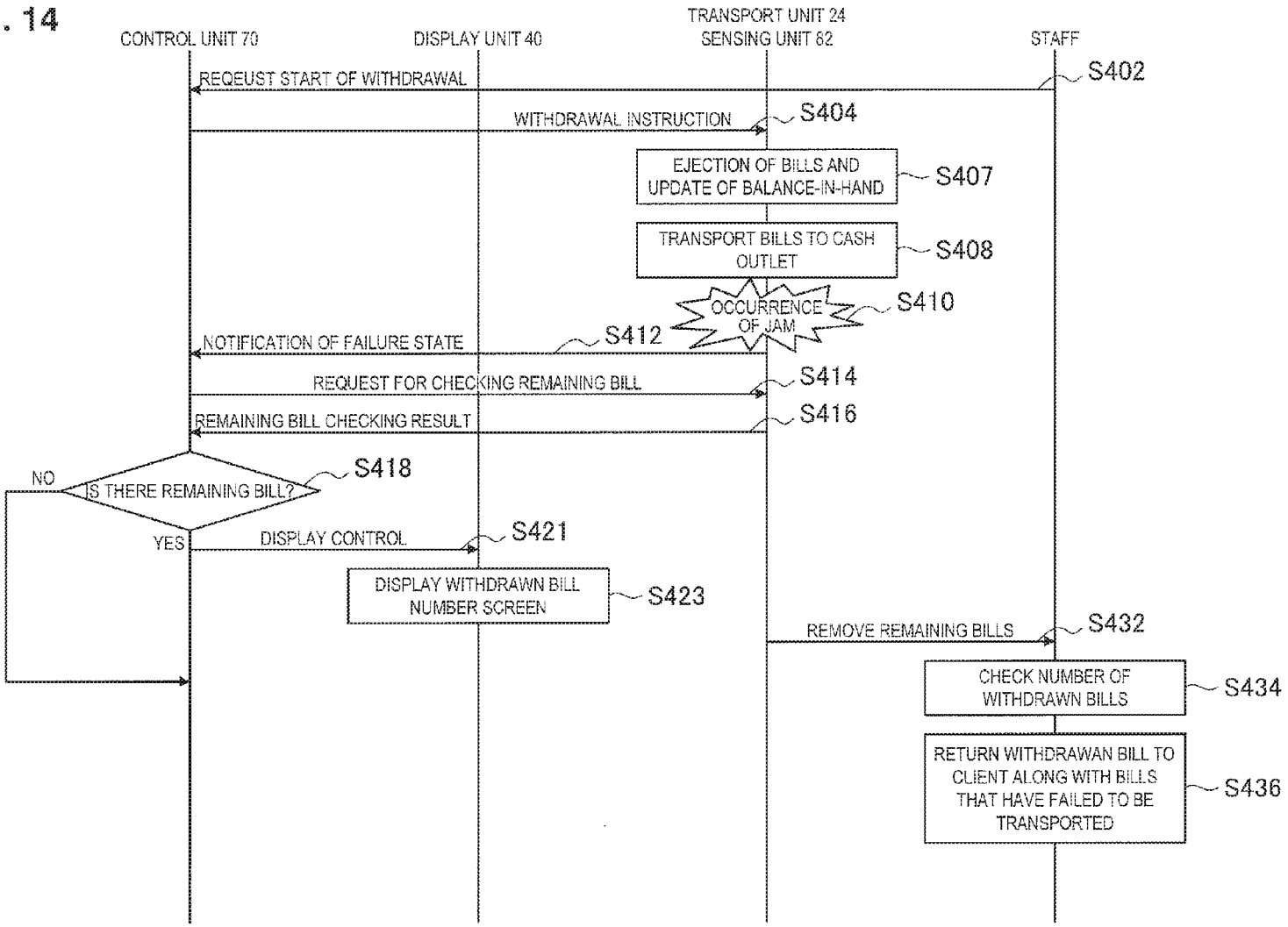
FIG. 14 is an illustrative diagram showing a withdrawal process when a balance-in-hand update timing is set to be a bill ejection time.

FIG. 14 is an illustrative diagram showing the withdrawal process when a balance-in-hand update timing is set to a bill ejection time. As shown in FIG. 14, when a staff requests a start of a withdrawal from the bill processing device 10 (S402), the control unit 70 instructs the transport unit 24 to eject bills in a designated amount from the bill cassettes 30 (S404). The transport unit 24 starts the ejection of the bills from the bill cassettes 30 based on the instruction (S407), and transports the ejected bills to the cash outlet 18 (S408). Here, the transport unit 24 or the control unit 70 updates the balance-in-hand at the timing at which the bills are ejected from the bill cassettes 30. In other words, each time one bill is ejected from the bill cassettes 30, the transport unit 24 or the control unit 70 subtracts one bill from the balance-in-hand of the corresponding denomination.

Then, when a jam occurs before all the bills of the designated amount arrive at the cash outlet 18 (S410), a notification of a failure state is output to the control unit 70 in a state in which the bills remain in the transport unit 24 and the cash outlet 18 (S412).

Upon receiving the notification of the failure state, the control unit 70 requests checking of whether or not there is a remaining bill to be removed inside the bill processing device 10 from the sensing unit 82 (S414), and the sensing unit 82 responds with presence or absence and the position of the remaining bill to be removed inside the bill processing device 10 (S416).

Figure 15:
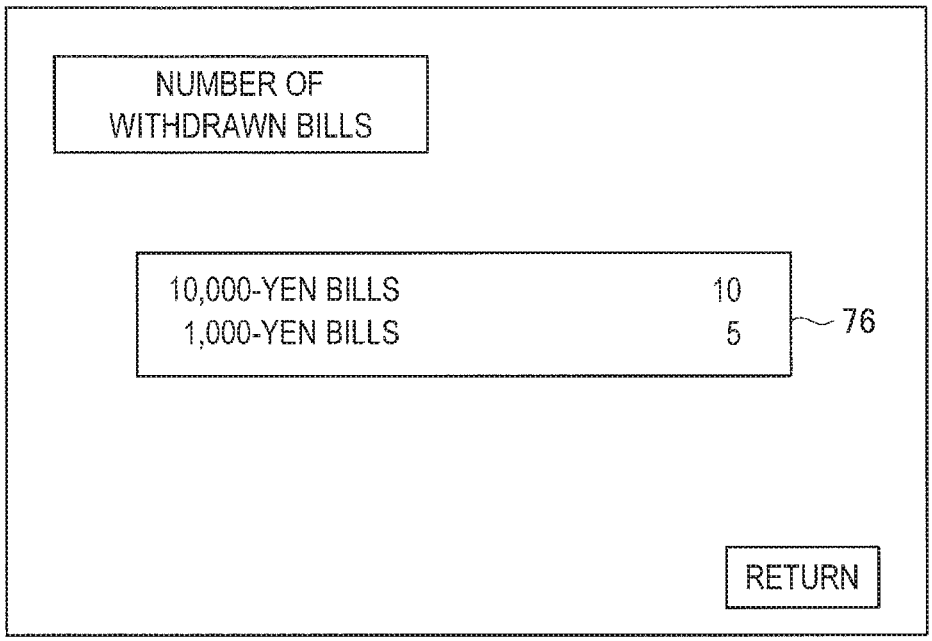
FIG. 15 is an illustrative diagram showing a specific example of a withdrawn bill number screen.

Then, when there is a remaining bill (yes in S418), the display unit 40 displays a withdrawn bill number screen indicating the number of bills ejected from the bill cassettes 30 based on the control of the control unit 70 (S421 and S423). The withdrawn bill number screen may include withdrawal information 76 indicating the number of withdrawn bills of each denomination as shown in FIG. 15. Furthermore, the withdrawn bill number screen may include a message instructing to remove the remaining bill. Alternatively, the withdrawn bill number screen may be displayed after a transition from a removal instruction screen instructing to remove the remaining bill.

The staff receives the display of the withdrawn bill number screen, and removes the bill remaining inside the bill processing device 10 (S432). Here, in the present example in which a balance-in-hand update timing is a bill ejection time, a balance-in-hand update process has been performed in the stage of S432 in which the staff removes the remaining bill, and thus the remaining bill is a bill that the bill processing device 10 recognizes as having been discharged from the device. For this reason, the staff can return the remaining bill to a client, and the staff does not have to return the remaining bill to the bill processing device 10 or to keep the bill separately. Specifically, the staff checks whether or not the number of removed remaining bills matches the number of withdrawn bills shown on the withdrawn bill number screen (S434), and when matching is confirmed, the removed remaining bill can be returned to the client along with bills that have failed to be transported (S436). For example, when withdrawal-requested bills are 50 ten-thousand-yen bills and the removed remaining bills are 45 ten-thousand-yen bills, the staff returns the 45 ten-thousand-yen bills to the client along with 5 ten-thousand-yen bills that have failed to be transported. Note that a bill that fails to be transported can be returned in a withdrawal process after restoration of the bill processing device 10. In addition, when a removed remaining bill is damaged, a staff may return another bill to a client, instead of the removed remaining bill.

As described above, when a balance-in-hand update timing is a bill ejection time, a staff may not keep a remaining bill in a separate place from the bill cassettes 30 of the bill processing device 10, and thus it is possible to prevent a mismatch from occurring in the balancing process due to a loss of a remaining bill. In addition, when a balance-in-hand update timing is a bill ejection time, there is no remaining bill to be counted as separate work in the balancing process, and therefore it is expected that a workload and a work time necessary for the balancing process are reduced.

<6. Fourth Operation>

The third operation that can be performed by the bill processing device 10 has been described above. Next, a fourth operation that can be performed by the bill processing device 10 will be described. The fourth operation is an operation relating to a deposit process. In particular, the fourth operation relates to shutter control when a failure occurs in a deposit process. According to the fourth operation, it is possible to quickly return a deposited bill to a customer when a failure occurs in a deposit process as will be descried below in detail. A setting screen for a shutter control in a deposit process will be described, and then the flow of a process according to each round of shutter control will be described below.

(Setting Screen for Shutter Control)

Figure 16:
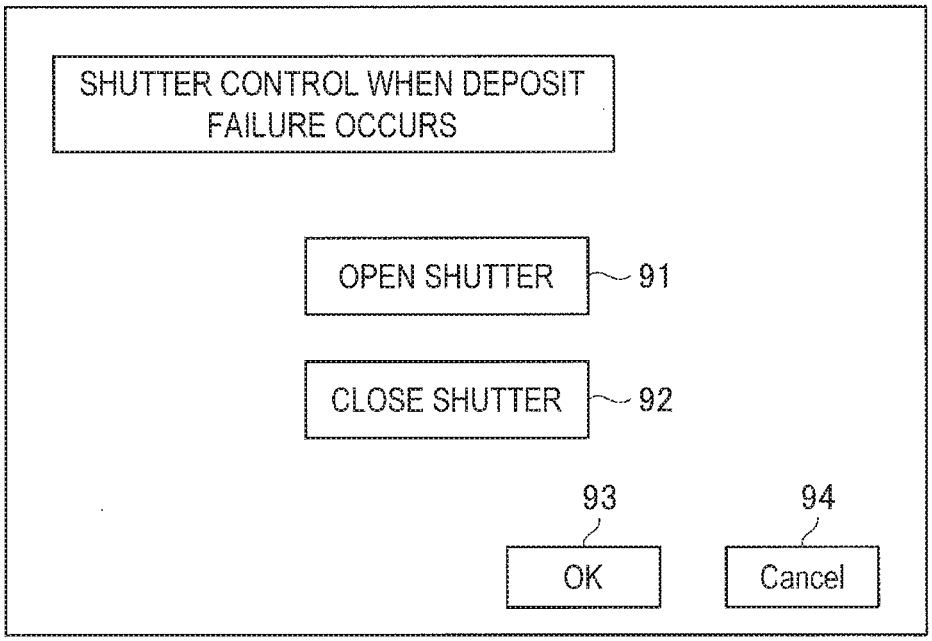
FIG. 16 is an illustrative diagram showing a specific example of a setting screen for a shutter control in a deposit process.

FIG. 16 is an illustrative diagram showing a specific example of a setting screen for a shutter control in a deposit process. As shown in FIG. 16, the setting screen for the shutter control includes a shutter opening selection button 91, a shutter closing selection button 92, an OK button 93, and a cancel button 94.

The shutter opening selection button 91 is a selection button for choosing to open the cash inlet shutter 13 when a failure (a jam) occurs in a deposit process. The shutter closing selection button 92 is a selection button for choosing to maintain the closed cash inlet shutter 13 when a jam occurs in a deposit process. The OK button 93 is a selection button for confirming a setting of the shutter control, and the cancel button 74 is a selection button for maintaining a current setting of the shutter control.

By manipulating the setting screen of the shutter control, a staff can set the shutter control when a failure occurs in a deposit process.

(When Deposit Failure Occurs: Open Shutter)

Next, a process when the shutter control in a deposit process is to "open the shutter" will be described with reference to FIG. 17.

Figure 17:
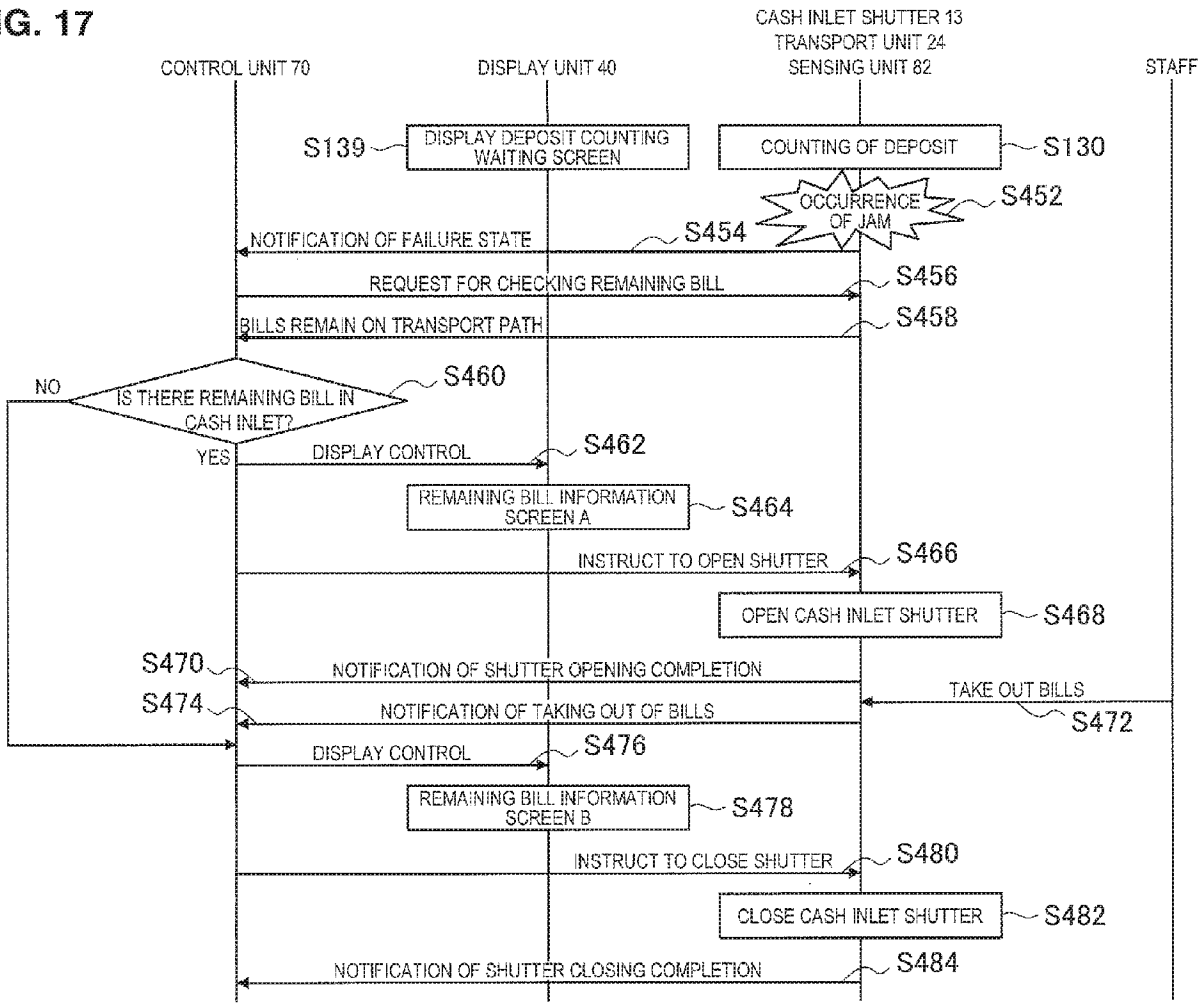
FIG. 17 is an illustrative diagram showing a process performed when a shutter control in a deposit process is "open shutter."

FIG. 17 is an illustrative diagram showing a process performed when a shutter control in a deposit process is to "open the shutter." The preceding processes before S130 and S139 of FIG. 17 are the same as from the preceding processes before S130 and S139 shown in FIG. 4, FIG. 6 or FIG. 9.

As shown in FIG. 17, when a jam occurs during a counting process in which deposited bills are being transported from the cash inlet 12 to the temporary reserving unit 22 (S452), a notification of a failure state is output to the control unit 70 in a state in which the bills remain in the transport unit 24 and the cash inlet 12 (S454).

Upon receiving the notification of the failure state, the control unit 70 requests checking of whether or not there is a remaining bill to be removed inside the bill processing device 10 from the sensing unit 82 (S456), and then the sensing unit 82 responds with presence or absence and the position of remaining bills to be removed inside the bill processing device 10 (S458). Note that remaining bills to be removed inside the bill processing device 10 include bills remaining in the transport unit 24 and bills remaining in the cash inlet 12. In addition, it is assumed here that the sensing unit 82 notifies the control unit 70 about the fact that there are bills remaining in the transport unit 24.

Figure 18:
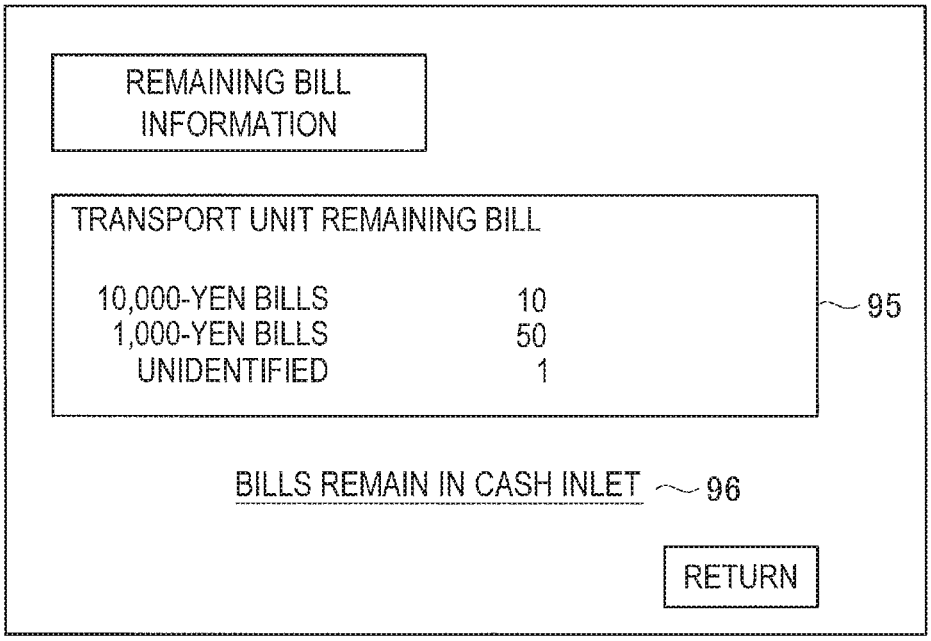
FIG. 18 is an illustrative diagram showing an example of a remaining bill information screen.

Then, when there is a remaining bill in the cash inlet 12 (yes in S460), the display unit 40 displays a remaining bill information screen A based on the control of the control unit 70 (S462 and S464). The remaining bill information screen A includes a transport unit remaining bill information 95 indicating that the number of bills remaining in the transport unit 24 associated with their respective denominations and a message 96 indicating that there are bills remaining in the cash inlet 12 as shown in FIG. 18.

Next, the control unit 70 instructs to open the cash inlet shutter 13 (S466), then the cash inlet shutter 13 is opened based on the instruction (S468), and then a notification of a shutter opening completion is output to the control unit 70 (S470).

Figure 19:
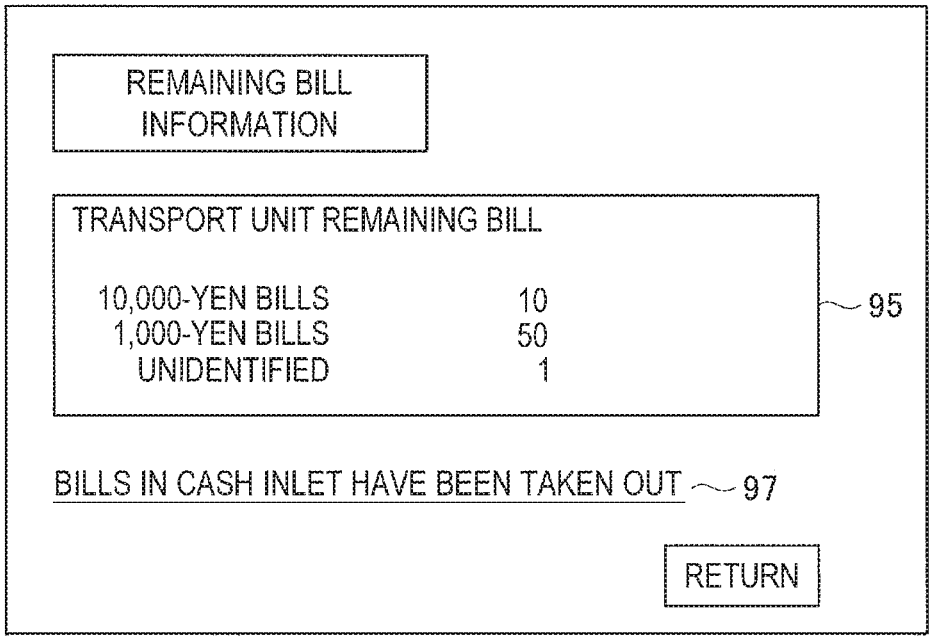
FIG. 19 is an illustrative diagram showing another example of a remaining bill information screen.

When the staff takes out the bills from the cash inlet 12 (S472) in response to the opening of the cash inlet shutter 13, a notification of taking out of the bills is output from the sensing unit 82 to the control unit 70 (S474). Upon receiving the notification of the taking out of the bills, or when there is no remaining bill in the cash inlet 12 (no in S460), the control unit 70 causes the display unit 40 to display a remaining bill information screen B (S476 and S478). The remaining bill information screen B includes a transport unit remaining bill information 95 indicating bills remaining in the transport unit 24 and a message 97 indicating that bills in the cash inlet 12 have been taken out, as shown in FIG. 19.

Thereafter, the control unit 70 instructs to close the cash inlet shutter 13 (S480), then the cash inlet shutter 13 is closed based on the instruction (S482), and then a notification of a shutter closing completion is output to the control unit 70 (S484). Then, as the staff removes the remaining bills from the transport unit 24 separately, the bill processing device 10 is restored.

As described above, in the fourth operation, the cash inlet shutter 13 is automatically opened when a jam occurs during the counting of a deposit. For this reason, bills remaining in the cash inlet 12 can be quickly removed and returned to a client. In addition, through the display of the remaining bill information screen, a staff can ascertain the number of bills remaining in the transport unit associated with their denominations and presence or absence of bills remaining in the cash inlet 12. Note that, when a shutter control is to "close the shutter" in a deposit process, the cash inlet shutter 13 is maintained to be closed after the occurrence of the jam. In the fourth operation, since any control operation is selected from the plurality of control operations above, it is possible to flexibly respond to changes of specification made in management.

<7. Conclusion>

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

Although the example in which the cash inlet 12 is separately provided from the cash outlet 18 has been described above as an example, the bill processing device 10 may have a service window that has a combined function of the cash inlet 12 and the cash outlet 18.

In addition, although the bill processing device 10 is described as a cash processing device and bills as an example of cash to be processed above, the embodiment of the present invention is not limited thereto. For example, the embodiment of the present invention can be applied also to a coin processing device whose cash target to be processed is coins.

In addition, the respective steps in the processes of the bill processing device 10 in the present specification are not necessarily processed in chronological order along the orders described in the sequence diagrams. For example, the respective steps in the processes of the bill processing device 10 may be processed in orders different from the orders described in the sequence diagrams or may be processed in parallel.

In addition, a computer program for causing a hardware included in the bill processing device 10 to exhibit the functions similar to those of the respective structural elements of the bill processing device 10 described above can also be created. Examples of the hardware includes a CPU, ROM, and RAM. In addition, a memory medium in which the computer program is memorized is also provided.

REFERENCE SIGNS LIST

10 bill processing device
12 cash inlet
13 cash inlet shutter
18 cash outlet
19 cash outlet shutter
20 bill recognition unit
22 temporary reserving unit
24 transport unit
30 bill cassette
36 bill storage
37 reject storage
40 display unit
42 manipulation unit
70 control unit
80 memory unit
82 sensing unit

The invention claimed is:

1. A cash processing device comprising:
a cash inlet having an opening and closing member;
a temporary reserving unit configured to temporarily store cash;
a storage unit configured to store cash;
a recognition unit configured to discriminate cash;
a transport unit configured to, in a deposit process, transport cash input into the cash inlet to the temporary reserving unit in a state in which the opening and closing member is closed, and transport cash stored in the temporary reserving unit to the storage unit; and
a control unit configured to control a display of (1) a selection screen for selecting a first deposit method of performing an input of cash at one time in one transaction or a second deposit method ofserforming in one transaction repeated inputs of cash over a plurality of times, and (2) a deposit information screen, including a counting result obtained by the recognition unit, after the transport of the cash input to the cash inlet to the temporary reserving unit ends, and further configured to not instruct to open the opening and closing member when the first deposit method is selected and to instruct to open the opening and closing member when the second deposit method is selected, after receipt by the device of a confirmation that the counting result is correct, and before the transport of the cash stored in the temporary reserving unit to the storage unit ends.

2. The cash processing device according to claim 1, wherein the control unit controls a display of the selection screen before a first input of cash into the cash inlet in one transaction.

3. The cash processing device according to claim 1, wherein the control unit controls a display of the selection screen after cash input into the cash inlet first in one transaction is transported to the temporary reserving unit.

4. The cash processing device according to claim 1, wherein, in the second deposit method, the control unit instructs to open the opening and closing member before an instruction to transport cash stored in the temporary reserving unit to the storage unit is issued.

5. The cash processing device according to claim 1, wherein, in the second deposit method, the control unit instructs to close the opening and closing member after transport of cash stored in the temporary reserving unit to the storage unit ends.

6. The cash processing device according to claim 1, wherein, in second and succeeding inputs of cash in the second deposit method, when an input of cash into the cash inlet is sensed after an instruction to open the opening and closing member is issued, the control unit instructs to close the opening and closing member based on the sensing.

7. The cash processing device according to claim 1, wherein, when a jam occurs during transport of cash from the cash inlet to the temporary reserving unit in the deposit process and cash remains in the cash inlet, the control unit instructs to open the opening and closing member.

8. The cash processing device according to claim 1, further comprising:
a cash outlet through which a client receives cash,
wherein, in a withdrawal process, the transport unit transports cash to the cash outlet from the storage unit and updates balance-in-hand of the storage unit at a timing at which the cash is ejected from the storage unit.

9. The cash processing device according to claim 8, wherein the control unit controls a display of a screen for selecting a timing at which the balance-in-hand of the storage unit is updated from a plurality of timings including a timing at which cash is ejected from the storage unit.

10. The cash processing device according to claim 8, wherein, when a jam occurs in the withdrawal process, the control unit controls a display of a screen indicating cash that has been transported to the cash outlet and cash remaining in the transport unit.

11. The cash processing device according to claim 10, wherein the control unit controls a display of a screen for selecting a timing at which the balance-in-hand of the storage unit is updated from a plurality of timings including a timing at which cash is ejected from the storage unit.

12. The cash processing device according to claim 10, wherein, when a jam occurs during transport of cash from the cash inlet to the temporary reserving unit in the deposit process, the control unit controls a display of a screen indicating cash remaining in the transport unit.

13. The cash processing device according to claim 12, wherein the screen indicating the cash remaining in the transport unit further indicates whether or not cash remains in the cash inlet.

14. A cash processing method executed by a cash processing device which has a cash inlet having an opening and closing member, a temporary reserving unit configured to temporarily store cash, a storage unit configured to store cash, a recognition unit configured to discriminate cash and a transport unit configured to, in a deposit process, transport cash input into the cash inlet to the temporary reserving unit in a state in which the opening and closing member is closed and transport cash stored in the temporary reserving unit to the storage unit, the cash processing method comprising:

controlling a display of a selection screen for selecting a first deposit method of performing an input of cash at one time in one transaction, or a second deposit method of performing in one transaction repeated inputs of cash over plurality of times;

displaying a deposit information screen including a counting result obtained by the recognition unit, after the transport of the cash input to the cash inlet to the temporary reserving unit ends; and issuing no instruction to open the opening and closing member when the first deposit method is selected, and instructing to open the opening and closing member when the second deposit method is selected, after receipt by the device of a confirmation that the counting result is correct, and before the transport of the cash stored in the temporary reserving unit to the storage unit ends.

* * * * *